US008144146B2

(12) United States Patent
Yamazaki et al.

(10) Patent No.: US 8,144,146 B2
(45) Date of Patent: Mar. 27, 2012

(54) DISPLAY DEVICE AND ELECTRONIC DEVICE

(75) Inventors: Shunpei Yamazaki, Tokyo (JP); Jun Koyama, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 1007 days.

(21) Appl. No.: 11/579,818

(22) PCT Filed: May 16, 2005

(86) PCT No.: PCT/JP2005/009291

§ 371 (c)(1),
(2), (4) Date: Nov. 7, 2006

(87) PCT Pub. No.: WO2005/114630

PCT Pub. Date: Dec. 1, 2005

(65) Prior Publication Data

US 2008/0030434 A1 Feb. 7, 2008

(30) Foreign Application Priority Data

May 21, 2004 (JP) ..... 2004-152600

(51) Int. Cl.
*G09G 3/32* (2006.01)
*G09G 5/00* (2006.01)

(52) U.S. Cl. ..... 345/214; 345/82

(58) Field of Classification Search ..... 345/82, 345/214, 76, 83

See application file for complete search history.

(56) References Cited

U.S. PATENT DOCUMENTS 4,483,602 A 11/1984 Aoki et al.
5,168,270 A 12/1992 Masumori et al.
5,247,190 A 9/1993 Friend et al.
5,399,502 A 3/1995 Friend et al.
5,597,223 A 1/1997 Watanabe et al.
5,615,027 A 3/1997 Kuribayashi et al.
5,745,085 A 4/1998 Tomio et al.
5,886,474 A 3/1999 Asai et al.

(Continued)

FOREIGN PATENT DOCUMENTS

EP 1 225 557 A1 7/2002

(Continued)

OTHER PUBLICATIONS

Schenk et al., Eurodisplay '99 Proceedings of the 19th International Display Research Conference Proceedings Polymers for Light Emitting Diodes, pp. 33-37, Sep. 6-9, 1999.

(Continued)

*Primary Examiner* — Amr Awad
*Assistant Examiner* — Randal Willis
(74) *Attorney, Agent, or Firm* — Nixon Peabody LLP; Jeffrey L. Costellia

(57) ABSTRACT

The display device of the invention includes a light emitting element, a monitoring light emitting element, a constant current source which supplies a constant current to the monitoring light emitting element, a time-based measurement circuit which measures time to supply a power source to the light emitting element, a memory circuit which stores V-I characteristics with time of the light emitting element, a correction data forming circuit which forms correction data based on an output of the monitoring light emitting element, an output of the time-based measurement circuit, and the characteristics with time, and a power source circuit which corrects a power source potential based on the correction data and supplies the corrected power source potential to the light emitting element.

26 Claims, 12 Drawing Sheets

U.S. PATENT DOCUMENTS

| | | | | |
|---|---|---|---|---|
| 5,990,629 | A | 11/1999 | Yamada et al. | |
| 6,069,676 | A | 5/2000 | Yuyama | |
| 6,072,448 | A | 6/2000 | Kojima et al. | |
| 6,124,840 | A * | 9/2000 | Kwon | 345/100 |
| 6,320,325 | B1 | 11/2001 | Cok et al. | |
| 6,356,029 | B1 | 3/2002 | Hunter | |
| 6,392,617 | B1 | 5/2002 | Gleason | |
| 6,404,137 | B1 | 6/2002 | Shodo | |
| 6,411,306 | B1 | 6/2002 | Miller et al. | |
| 6,414,661 | B1 | 7/2002 | Shen et al. | |
| 6,424,326 | B2 * | 7/2002 | Yamazaki et al. | 345/77 |
| 6,496,218 | B2 | 12/2002 | Takigawa et al. | |
| 6,501,230 | B1 | 12/2002 | Feldman | |
| 6,518,962 | B2 | 2/2003 | Kimura et al. | |
| 6,528,951 | B2 | 3/2003 | Yamazak et al. | |
| 6,583,775 | B1 | 6/2003 | Sekiya et al. | |
| 6,611,108 | B2 | 8/2003 | Kimura | |
| 6,624,857 | B1 | 9/2003 | Nagata et al. | |
| 6,750,835 | B2 | 6/2004 | Azami | |
| 6,828,950 | B2 | 12/2004 | Koyama | |
| 6,847,341 | B2 | 1/2005 | Kimura et al. | |
| 6,856,307 | B2 | 2/2005 | Osame et al. | |
| 6,930,665 | B2 | 8/2005 | Sekine | |
| 7,049,991 | B2 | 5/2006 | Kimura | |
| 7,053,874 | B2 | 5/2006 | Koyama | |
| 7,119,767 | B1 | 10/2006 | Komiya et al. | |
| 7,129,918 | B2 | 10/2006 | Kimura | |
| 7,154,466 | B2 | 12/2006 | Osame et al. | |
| 7,173,370 | B2 | 2/2007 | Seo et al. | |
| 7,221,338 | B2 | 5/2007 | Yamazaki et al. | |
| 7,227,519 | B1 | 6/2007 | Kawase et al. | |
| 7,262,757 | B2 * | 8/2007 | Morita et al. | 345/99 |
| 7,298,347 | B2 | 11/2007 | Yamazaki et al. | |
| 2001/0022565 | A1 | 9/2001 | Kimura | |
| 2001/0040565 | A1 | 11/2001 | Koyama | |
| 2001/0052898 | A1 | 12/2001 | Osame et al. | |
| 2002/0011796 | A1 | 1/2002 | Koyama | |
| 2002/0015032 | A1 * | 2/2002 | Koyama et al. | 345/204 |
| 2002/0117962 | A1 | 8/2002 | Beierlein et al. | |
| 2003/0052843 | A1 | 3/2003 | Yamazaki et al. | |
| 2003/0071804 | A1 * | 4/2003 | Yamazaki et al. | 345/204 |
| 2003/0090481 | A1 | 5/2003 | Kimura | |
| 2003/0146896 | A1 | 8/2003 | Sekine | |
| 2003/0201727 | A1 * | 10/2003 | Yamazaki et al. | 315/169.1 |
| 2003/0203523 | A1 | 10/2003 | Yamazaki et al. | |
| 2003/0209989 | A1 | 11/2003 | Anzai et al. | |
| 2003/0214467 | A1 * | 11/2003 | Koyama et al. | 345/82 |
| 2004/0046757 | A1 | 3/2004 | Yamada | |
| 2004/0150594 | A1 | 8/2004 | Koyama et al. | |
| 2005/0205880 | A1 | 9/2005 | Anzai et al. | |
| 2005/0280766 | A1 | 12/2005 | Johnson et al. | |
| 2006/0103684 | A1 | 5/2006 | Yamazaki et al. | |
| 2006/0119555 | A1 | 6/2006 | Yamada | |
| 2007/0115223 | A1 | 5/2007 | Kimura | |
| 2007/0228362 | A1 | 10/2007 | Seo et al. | |
| 2009/0237390 | A1 | 9/2009 | Koyama et al. | |

FOREIGN PATENT DOCUMENTS

| | | | |
|---|---|---|---|
| EP | 1 310 937 | A1 | 5/2003 |
| JP | 10-92576 | | 4/1998 |
| JP | 2001-100696 | | 4/2001 |
| JP | 2001-324958 | | 11/2001 |
| JP | 2002-229513 | | 8/2002 |
| JP | 2002-278514 | | 9/2002 |
| JP | 2002-372949 | | 12/2002 |
| JP | 2003-029710 | | 1/2003 |
| JP | 2003-202832 | | 7/2003 |
| JP | 2003-216110 | | 7/2003 |
| JP | 2003-228339 | | 8/2003 |
| JP | 2003-323154 | | 11/2003 |
| JP | 2003-330419 | | 11/2003 |
| JP | 2004-070349 | | 3/2004 |
| JP | 2004-146936 | | 5/2004 |
| WO | WO 90/13148 | | 11/1990 |
| WO | WO 01/63587 | A2 | 8/2001 |
| WO | WO 2004/025615 | A1 | 3/2004 |

OTHER PUBLICATIONS

Written Opinion of the International Searching Authority for PCT/JP2005/009291 Dated Aug. 23, 2005.

International Search Report for PCT/JP2005/009291 Dated Aug. 23, 2005.

European Search Report—Application No. 05740917.9 mailed Sep. 18, 2007.

Tsutsui.T et al., "Electroluminescence in Organic Thin Films,", Photochemical Processes in Organized Molecular Systems, 1991, pp. 437-450.

Baldo.M et al., "Highly Efficient Phosphorescent Emission From Organic Electroluminescent Devices,", Nature, Sep. 10, 1998, vol. 395, pp. 151-154.

Baldo.M et al., "Very High-Efficiency Green Organic Light-Emitting Devices Based on Electrophosphorescence,", Appl. Phys. Lett. (Applied Physics Letters) , Jul. 5, 1999, vol. 75, No. 1, pp. 4-6.

Tsutsui.T et al., "High Quantum Efficiency in Organic Light-Emitting Devices With Iridium-Complex as a Triplet Emissive Center,", Jpn. J. Appl. Phys. (Japanese Journal of Applied Physics) , Dec. 15, 1999, vol. 38, No. 12B, pp. L1502-L1504.

Kimura.M et al., "TFT-LEPD With Image Uniformity by Area Ratio Gray Scale,", EURODISPLAY '99 : The 19th International Display Research Conference, Sep. 6, 1999, pp. 71-74.

Shimoda.T et al., "Technology for Active Matrix Light Emitting Polymer Displays,", IEDM 99: Technical Digest of International Electron Devices Meeting, 1999, pp. 107-110.

Shimoda.T et al., "Current Status and Future of Light-Emitting Polymer Display Driven by Poly-Si TFT,", SID Digest '99 : SID International Symposium Digest of Technical Papers, May 18, 1999, vol. 30, pp. 372-375.

Han.C et al., "3.8inch Green OLED With Low Temperature Poly SI TFT,", EURODISPLAY '99 : The 19th International Display Research Conference, Sep. 6, 1999, pp. 27-30.

Kimura.M et al., "Low-Temperature Poly-Si TFT Driven Light-Emitting-Polymer Displays and Digital Gray Scale For Uniformity ,", IDW '99 : Proceedings of the 6th International Display Workshops, 1999, pp. 171-174.

Shimoda.T et al., "High Resolution Light Emitting Polymer Display Driven by Low Temperature Polysilicon Thin Film Transistor With Integrated Driver,", Asia Display '98 : Proceedings of the 18th IDRC (International Display Research Conference), 1998, pp. 217-220.

* cited by examiner

DISPLAY DEVICE AND ELECTRONIC DEVICE

TECHNICAL FIELD

The present invention relates to a display device and a television device each having a self-light emitting element.

The invention relates to an electronic device using a display device having a self-light emitting element.

BACKGROUND ART

In recent years, a display device having a light emitting element represented by an EL (Electro Luminescence) element has been developed and expected to be widely used by taking advantages of high image quality, wide viewing angle, thin design, light weight and the like as a self-light emitting type (for example, see Patent Document 1).

[Patent Document 1]

Japanese Patent Laid-Open No. 2003-323154

DISCLOSURE OF INVENTION

A light emitting element has a property that a resistance value (internal resistance) changes in accordance with the ambient temperature (hereinafter referred to as the environment temperature). In specific, with a room temperature set as a normal temperature, when the temperature becomes higher than the normal temperature, the resistance value decreases while the resistance value increases when the temperature becomes lower than the normal temperature. Accordingly, when the temperature rises, a luminance higher than desired is obtained as a current value increases. Thus, in the case of applying the same voltage at a lower temperature, a luminance lower than desired is obtained as a current value decreases. Such a property of a light emitting element is shown in a graph of a relationship between voltage-current characteristics (hereinafter called "V-I characteristics") of a light emitting element and temperature (see FIG. 1A). Further, a light emitting element has a property that a current value thereof decreases with time. Such a property of a light emitting element is shown in a graph of a relationship between V-I characteristics of a light emitting element and time (see FIG. 10B).

Due to the aforementioned properties of the light emitting element, luminance thereof varies when the environment temperature changes and changes with time occur. In view of the aforementioned, the invention provides a display device which suppresses an effect of variations in current value of a light emitting element due to the changes in the environment temperature and changes with time.

In view of the aforementioned, the invention provides a display device provided with a compensation function for the changes in the environment temperature and a compensation function for the changes with time. According to the invention, the display device includes a light emitting element, a monitoring light emitting element, a memory circuit which stores V-I characteristics of the light emitting element with time, and a power source circuit which supplies to the light emitting element a power source potential which is corrected based on an output and characteristics with time of the monitoring light emitting element.

According to the invention, the display device includes a light emitting element, a monitoring light emitting element, a memory circuit which stores V-I characteristics of the light emitting element with time, and a power source circuit which supplies to the light emitting element a power source potential which is corrected based on a potential of a first electrode of the monitoring light emitting element and characteristics with time.

According to the invention, the display device includes a light emitting element, a monitoring light emitting element, a memory circuit which stores V-I characteristics of a light emitting element with time, a power source circuit which supplies to the light emitting element a power source potential which is corrected based on an output and characteristics with time of the monitoring light emitting element, and a display region including a plurality of pixels. Each of the plurality of pixels includes a light emitting element, a first transistor which controls a video signal input to the pixel, a second transistor which controls light emission and no light emission of the light emitting element, and a capacitor which holds a video signal.

According to the invention, the display device includes a constant current source which supplies a constant current to a monitoring light emitting element. A light emitting element and the monitoring light emitting element included in the display device of the invention are provided over the same substrate.

According to the invention, one of a first electrode and a second electrode of a light emitting element of a display device transmits light while the other thereof reflects light. According to the invention, the first electrode and a second electrode of a light emitting element of a display device of the invention transmit light.

According to the invention, a television device includes a display device having any one of the aforementioned structures.

According to the invention, a display device includes a light emitting element, a monitoring light emitting element, a constant current source which supplies a constant current to the monitoring light emitting element, a time-based measurement circuit which measures time to supply a power source to the light emitting element, a memory circuit which stores V-I characteristics with time of the light emitting element, a correction data forming circuit which forms correction data based on an output of the monitoring light emitting element, an output of the time-based measurement circuit and characteristics with time, and the corrected power source circuit which corrects a power source potential based on the correction data and supplies a power source potential to the light emitting element are provided.

According to the invention, a display device includes a display region including a plurality of pixels each having a light emitting element, a monitoring light emitting element, a constant current source which supplies a constant current to the monitoring light emitting element, a time-based measurement circuit which measures time to supply a power source to the light emitting element, a memory circuit which stores V-I characteristics with time of the light emitting element, a correction data forming circuit which forms correction data based on an output of the monitoring light emitting element, an output and characteristics with time of the time-based measurement circuit, and a power source circuit which corrects a power source potential based on the correction data and supplies the corrected power source potential to the light emitting element.

According to the invention, an electronic device includes a display device having any one of the aforementioned structures.

Compared with the case of using a constant current drive, the invention which employs a constant voltage drive can operate with a lower driving voltage for a light emitting element, which results in reducing power consumption.

According to the invention which corrects a power source potential applied to a light emitting element by using a monitoring light emitting element, a display device which suppresses an effect of variations in current value of the light emitting element caused by changes in the environment temperature and changes with time can be provided.

BEST MODE FOR CARRYING OUT THE INVENTION

Figure 1:
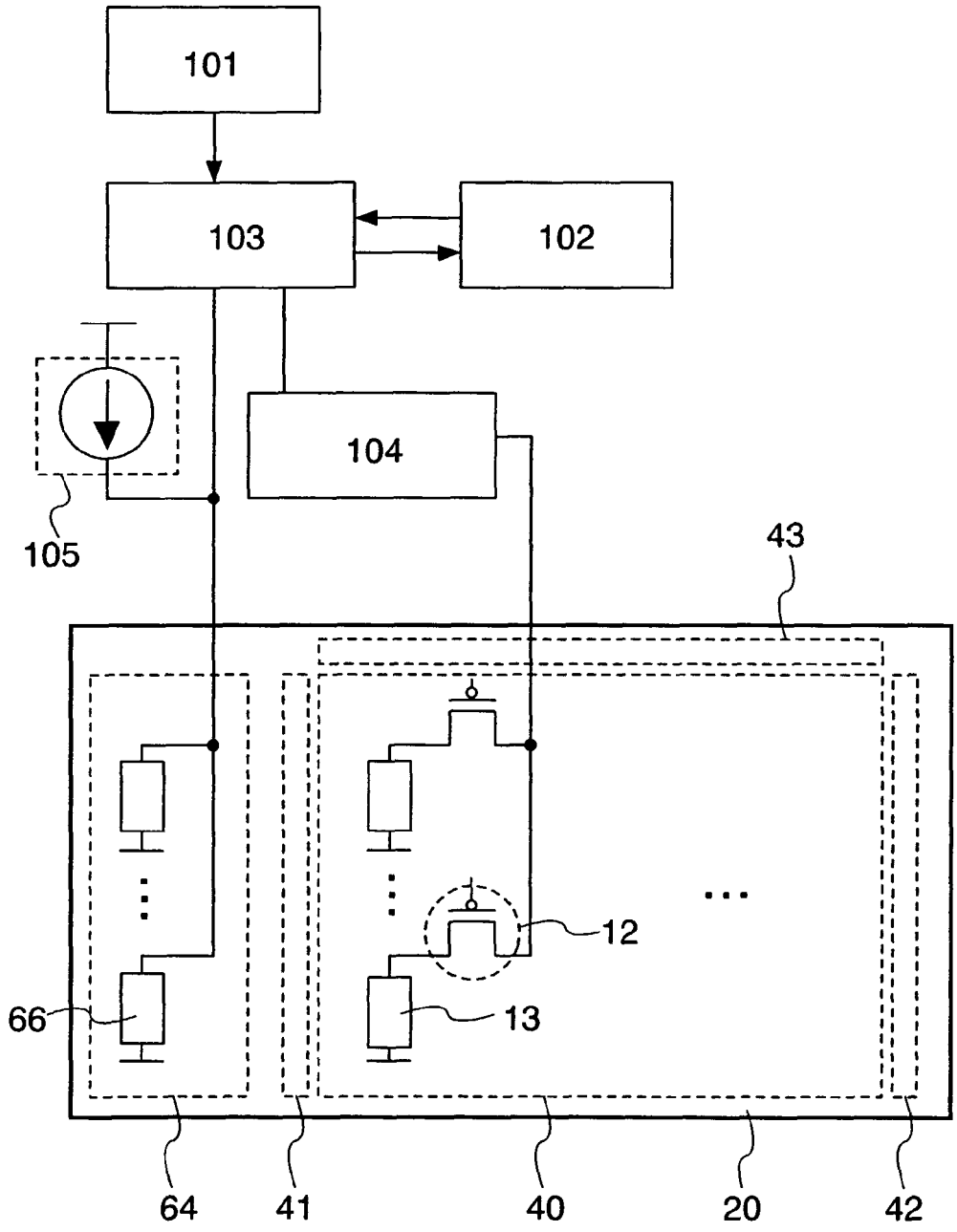
FIG. 1 is a diagram showing a structure of the display device of the invention.

Although the invention will be described by way of example with reference to the accompanying drawings, it is to be understood that various changes and modifications will be apparent to those skilled in the art. Therefore, unless such changes and modifications depart from the scope of the invention, they should be construed as being included therein. Note that identical portions in embodiment modes are denoted by the same reference numerals and detailed descriptions thereof are omitted.

Embodiment Mode 1

The display device of the invention includes a light emitting element 13 and a monitoring light emitting element 66 which are formed over the same substrate 20. That is, the light emitting element 13 and the monitoring light emitting element 66 are formed by the same manufacturing condition and steps, therefore, they have the same characteristics against the changes in environment temperature and changes with time.

The display device of the invention also includes a time-based measurement circuit 101, a memory circuit 102, a correction data forming circuit 103, a power source circuit 104, and a constant current source 105. These circuits may be formed over the same substrate 20 as the light emitting element 13 and the monitoring light emitting element 66 or may be formed over another substrate.

A plurality of pixels are arranged in matrix in a pixel region 40 over the substrate 20. The plurality of pixels each includes the light emitting element 13 and at least two transistors (only a driving transistor 12 is shown in FIG. 1). The light emitting element 13 is controlled to emit light or no light or controlled in luminance by a driver (here, a first gate driver 41, a second gate driver 42, and a source driver 43 are shown as examples) provided over the substrate.

One or a plurality of the monitoring light emitting elements 66 is provided over the substrate 20. A monitoring circuit 64 including one or a plurality of the monitoring light emitting element 66 may be provided in the pixel region 40 or may be provided in another region. However, it is preferable to provide the monitoring circuit 64 in a region other than the pixel region 40 so as not to have influence on an image display.

A constant current is supplied from the constant current source 105 to the monitoring light emitting element 66. When changes in the environment temperature and changes with time occur in this state, a resistance value of the monitoring light emitting element 66 itself changes. Accordingly, a potential difference between opposite electrodes of the monitoring light emitting element 66 changes as a current value of the monitoring light emitting element 66 is always constant.

In the aforementioned structure, a potential of an opposite electrode of the two electrodes of the monitoring light emitting element 66 does not change while a potential of an electrode (referred to as a first electrode here) connected to the constant current source 105 changes. The changed potential of the first electrode of the monitoring light emitting element 66 is outputted to the correction data forming circuit 103.

The time-based measurement circuit 101 has a function to measure time during which the power source circuit 104 supplies a power source to a panel having the light emitting element 13 or a function to sample a video signal supplied to each pixel of the pixel region 40 and measure light emission time of the pixel having the light emitting element 13. According to the latter function, a plurality of pixels each having the light emitting elements 13 are provided in the pixel region 40 and light emission time of the each pixel having the light emitting element 13 differs from each other. Therefore, it is preferable to calculate light emission time of the pixels each having the light emitting element 13 and then obtain an average value thereof. Alternatively, it is preferable to calculate light emission time of some of the pixels each having the light emitting element 13 and then obtain an average value thereof. The time-based measurement circuit 101 outputs to the correction data forming circuit 103 a signal containing data on the lapsed time obtained by one of the aforementioned functions.

The memory circuit 102 stores V-I characteristics with time of the light emitting element 13. That is, the memory circuit 102 stores V-I characteristics of the light emitting element 13 in each lapsed time and preferably stores 10,000 to 100,000 hours of characteristics. The memory circuit 102 outputs data on the V-I characteristics of the light emitting element 13 corresponding to the lapsed time based on a signal supplied from the time-based measurement circuit 101 to the correction data forming circuit 103.

The correction data forming circuit 103 calculates an optimum voltage condition for operating the light emitting element 13 based on the output of the monitoring light emitting element 66, the output of the time-based measurement circuit 101 and the output of the memory circuit 102. In other words, an optimum voltage condition for obtaining a desired luminance is calculated. Then, a signal containing data on the optimum voltage condition is outputted to the power source circuit 104.

The power source circuit 104 corrects a power source potential based on the signal supplied from the correction data forming circuit 103 and supplies the corrected power source potential to the light emitting element 13.

In the case of performing a color display using a panel including the light emitting element 13, it is preferable to provide electroluminescent layers of different wavelengths to each pixel, typically electroluminescent layers for each of red (R), green (G), and blue (B). In this case, it is preferable to provide the monitoring light emitting element 66 for each of red, green, and blue to correct a power source potential for each color.

In the case of performing a color display, a pixel for white (W) may be provided in addition to the pixels for red (R), green (G), and blue (B). In this case, the monitoring light emitting elements 66 for each of red, green, blue, and white is preferably provided to correct a power source potential for each color. In this manner, it is preferable to provide pixels for a plurality of colors and provide the monitoring light emitting elements 66 for those colors when performing a color display.

According to the invention having the aforementioned structure, a voltage condition of the light emitting element can be optimized by using the monitoring light emitting element 66, the time-based measurement circuit 101, and the memory circuit 102, thereby an effect of variations in current value of the light emitting element caused by both changes in the environment temperature and changes with time can be suppressed. Moreover, according to the invention, an operation by a user is not required, thus a long life as a product can be expected by continuing to perform correction after handed to an end user.

The duty ratios of the light emitting element 13 and the monitoring light emitting element 66 are different. This is because the light emitting element 13 emits light or no light based on video signals whereas the monitoring light emitting element 66 always emits light. In other words, the total amount of current supplied to the light emitting element 13 and the total amount of current supplied to the monitoring light emitting element 66 in a certain period (for example, one frame period) are different. Therefore, when the light emitting element 13 and the monitoring light emitting element 66 are compared, the monitoring light emitting element 66 changes its characteristics faster than the light emitting element 13. Accordingly, it is hard to suppress an effect of variations in current value of the light emitting element 13 caused by changes with time by only using the monitoring light emitting element 66 for compensating the changes with time. However, according to the invention, an effect of variations in current value of the light emitting element 13 caused by changes with time can be suppressed more accurately by using the time-based measurement circuit 101 and the memory circuit 102.

Either of an analog or digital video signal may be used for the display device of the invention. There are a digital video signal using voltage and a digital video signal using current in the case of using a digital video signal. That is, a video signal inputted to a pixel when the light emitting element emits light is a constant voltage or a constant current. When a video signal is a constant voltage, a constant voltage is applied to a light emitting element or a constant current is supplied to the light emitting element. When a video signal is a constant current, a constant voltage is applied to a light emitting element or a constant current is supplied to the light emitting element. When a constant voltage is applied to the light emitting element, a so-called a constant voltage drive is performed whereas when a constant current is supplied to the light emitting element, it is called a constant current drive. According to the constant current drive, a constant current is supplied to the light emitting element regardless of resistance variations of the light emitting element. A video signal of voltage is used for the display device of the invention.

Embodiment Mode 2

A structure example of the display device of the invention is described with reference to the drawings. The display device of the invention includes a plurality of pixels 10 each having a plurality of elements in a region where a source line Sx (x is a natural number, satisfying 1=x=m) and a gate line Gy (y is a natural number, satisfying 1=y=n) intersect with an insulator interposed therebetween (see FIG. 2A). The pixel 10 includes the light emitting element 13, a capacitor 16, and two transistors. One of the two transistors is a switching transistor 11 which controls a video signal input to the pixel 10 while the other is a driving transistor 12 which controls light emission and no light emission of the light emitting element 13. The switching transistor 11 and the driving transistor 12 are field effect transistors each having three terminals: a gate electrode, a source electrode, and a drain electrode.

The gate electrode of the switching transistor 11 is connected to the gate line Gy, one of the source electrode and the drain electrode thereof is connected to the source line Sx while the other is connected to the gate electrode of the driving transistor 12. One of the source electrode and the drain electrode of the driving transistor 12 is connected to a power source line Vx (x is a natural number, satisfying 1=x=m) while the other is connected to a pixel electrode of the light emitting element 13. An opposite electrode of the light emitting element 13 is connected to an opposite power source 18. The capacitor 16 is provided between the gate electrode and the source electrode of the driving transistor 12.

The conductivity of the switching transistor 11 and the driving transistor 12 is not limited and may be either an N-channel type or a P-channel type. In the shown structure, the switching transistor 11 is an N-channel type while the driving transistor 12 is a P-channel type. A potential of the power source line Vx and a potential of the opposite power source 18 are not limited either, although they are set at different potentials so that a forward bias or a reverse bias voltage is applied to the light emitting element 13.

The display device of the invention having the aforementioned structure has two transistors in the pixel 10. According to this feature that the number of transistors laid out in one pixel 10 can be small, the number of necessary wirings can be reduced and high aperture ratio, high definition, and high yield can be realized. With the high aperture ratio, light emission area increases, which can decrease the luminance of the light emitting element. In other words, a current density of the light emitting element can be decreased, which leads to decrease a driving voltage and reduces power consumption. By decreasing the driving voltage, reliability of the light emitting element 13 can be improved.

According to the display device of the invention, the driving transistor 12 operates in the linear region. According to this feature, a driving voltage of the light emitting element 13 can be lower than the case where the driving transistor 12 operates in the saturation region, thereby power consumption can be reduced.

A semiconductor which forms the switching transistor 11 and the driving transistor 12 may be any one of an amorphous semiconductor (amorphous silicon), a microcrystalline semiconductor, a polycrystalline semiconductor (polysilicon), an organic semiconductor and the like. The microcrystalline semiconductor may be formed by using a silane gas ($SiH_4$) and a fluorine gas ($F_2$), by using a silane gas and a hydrogen gas, or by irradiating laser light after forming a thin film by using the aforementioned gases.

The gate electrodes of the switching transistor 11 and the driving transistor 12 are each formed by a single layer or stacked layers of a conductive material. For example, a stacked-layer structure of tungsten (W) and tungsten nitride (WN, a composition ratio of tungsten (W) and nitrogen (N) is not restricted), a stacked-layer structure of molybdenum (Mo), aluminum (Al) and Mo, or a stacked-layer structure of Mo and molybdenum nitride (MoN, a composition ratio of molybdenum (Mo) and nitrogen (N) is not restricted) can be employed.

A conductive layer (a source wiring or a drain wiring) connected to an impurity region (a source electrode and a drain electrode) included in the switching transistor 11 and the driving transistor 12 is formed of a single layer or stacked layers of a conductive material. For example, a stacked-layer structure of titanium (Ti), aluminum silicon (Al—Si, a material containing aluminum (Al) as a main component and silicon (Si)) and Ti, a stacked-layer structure of Mo, Al—Si and Mo, or a stacked-layer structure of MoN, Al—Si, and MoN can be employed. Alternatively, a material containing aluminum as a main component and nickel, or an alloy material containing aluminum as a main component, nickel, and one or both of carbon and silicon is preferably used.

Figure 2B:
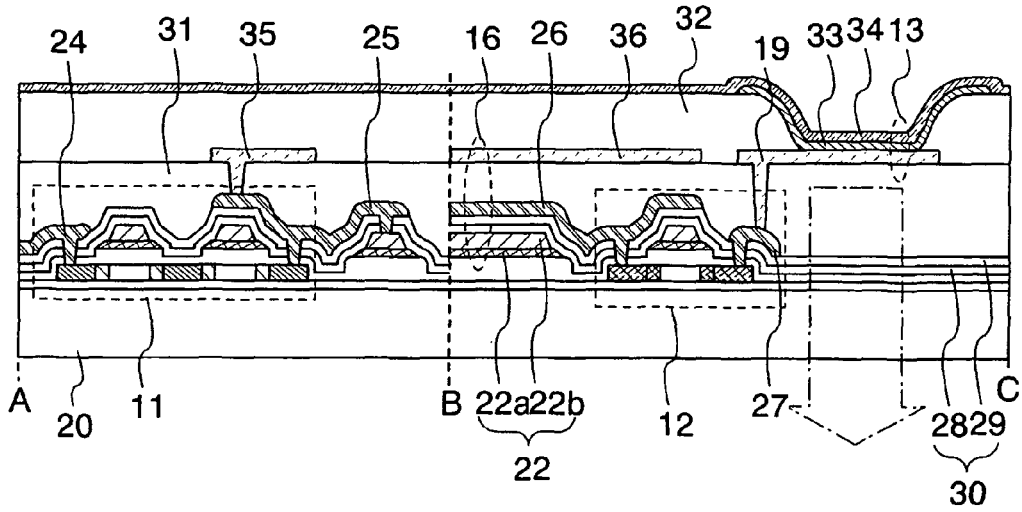
Figure 3:
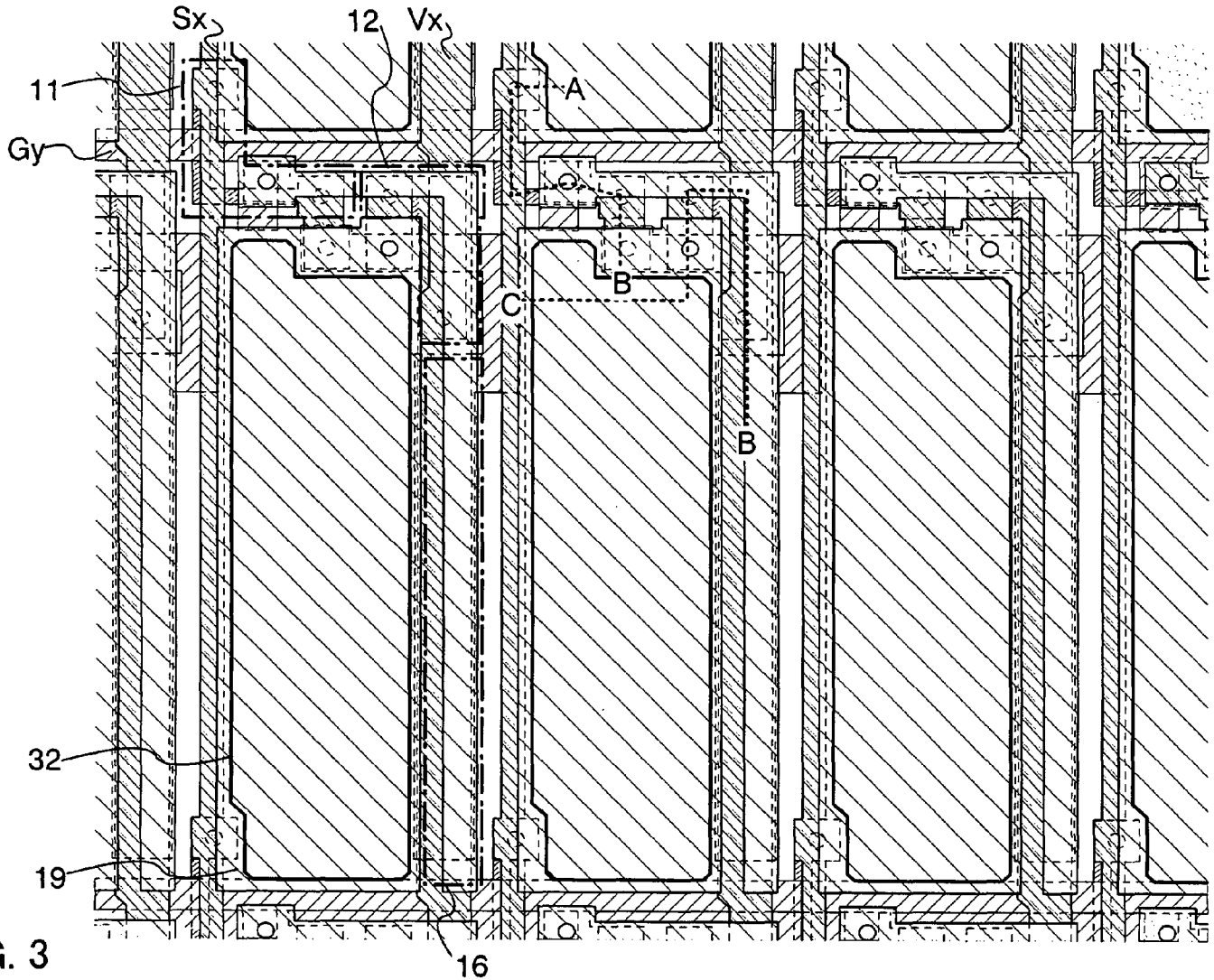
FIG. 3 is a diagram showing a layout of the display device of the invention.

A layout of the pixel 10 having the aforementioned structure is shown in FIG. 3. In this layout, the switching transistor 11, the driving transistor 12, the capacitor 16, and a conductive layer 19 corresponding to a pixel electrode of the light emitting element 13 are shown. FIG. 2B shows a sectional structure taken along A-B-C of this layout. The switching transistor 11, the driving transistor 12, the light emitting element 13, and the capacitor 16 are provided over the substrate 20 having an insulating surface such as a glass and quartz substrate.

The light emitting element 13 corresponds to a stacked-layer of the conductive layer 19 corresponding to the pixel electrode, an electroluminescent layer 33, and a conductive layer 34 corresponding to the opposite electrode. In the case where both of the conductive layers 19 and 34 transmit light, the light emitting element 13 emits light in the direction of the conductive layer 19 and the direction of the conductive layer 34. In other words, the light emitting element 13 performs dual light emission. In the case where one of the conductive layers 19 and 34 transmits light while the other reflects light, the light emitting element 13 emits light only in the direction of the conductive layer 19 or only in the direction of the conductive layer 34. In other words, the light emitting element 13 performs top light emission or bottom light emission. In FIG. 2B, a sectional structure of the light emitting element 13 which performs bottom light emission is shown.

The capacitor 16 is provided between the gate electrode and the source electrode of the driving transistor 12 and holds a gate-source voltage thereof. The capacitor 16 is formed by conductive layers 22*a* and 22*b* provided in the same layer as the gate electrodes of the switching transistor 11 and the driving transistor 12 (hereinafter collectively referred to as a conductive layer 22), a conductive layer 26 corresponding to a source wiring or a drain wiring of the driving transistor 12, and an insulating layer between the conductive layer 22 and the conductive layer 26.

The capacitor 16 is formed by the conductive layer 26 corresponding to the source wiring or a drain wiring of the driving transistor 12, a conductive layer 36 provided in the same layer as the pixel electrode of the light emitting element 13, and an insulating layer between the conductive layers 26 and 36. As shown in FIG. 3, the conductive layer 35 is connected to the conductive layer 36.

According to the aforementioned structure, the capacitor 16 can have sufficient capacitance to hold a gate-source voltage of the driving transistor 12. Moreover, the capacitor 16 is provided under the conductive layer which forms the power source line. Accordingly, aperture ratio does not decrease due to the capacitor 16 does not occur. As gate insulating films of the switching transistor 11 and the driving transistor 12 are not used for the capacitor 16, a gate leak current can be reduced, which leads to reduce power consumption.

Conductive layers 24 to 27 corresponding to the source wiring and the drain wiring of the switching transistor 11 and the driving transistor 12 each has a thickness of 500 to 2000 nm, and more preferably 500 to 1300 nm. The conductive layers 24 to 27 form the source line Sx and the power source line Vx, therefore, an effect of voltage drop can be suppressed by forming the conductive layers 24 to 27 thick as described above. It is to be noted that wiring resistance can be decreased by forming the conductive layers 24 to 27 thick. However, too thick conductive layers make an accurate patterning difficult and projections and depressions over the surfaces thereof become obstacles. Therefore, the thickness of the conductive layers 24 to 27 is preferably determined in the aforementioned range in consideration of the difficulty in patterning and an effect of projections and depressions over the surfaces.

The display device of the invention includes the switching transistor 11, insulating layers 28 and 29 which cover the driving transistor 12 (hereinafter collectively referred to as a first insulating layer 30), a second insulating layer 31 provided over the first insulating layer 30, and the conductive layer 19 corresponding to the pixel electrode over the second insulating layer 31. Provided that the second insulating layer 31 is not formed, the conductive layer 19 and the conductive layers 24 to 27 corresponding to a source wiring or a drain wiring are provided in the same layer. Then, a region where the conductive layer 19 is provided is restricted to be other than a region where the conductive layers 24 to 27 are provided. By providing the second insulating layer 31, however, the region where the conductive layer 19 is provided expands, thus high aperture ratio can be realized. This structure is efficient in the case of the top light emission, in particular With the high aperture ratio, light emission area increases, which can decrease the driving voltage and reduce power consumption.

It is to be noted that the first insulating layer 30 and the second insulating layer 31 are formed of an inorganic material such as silicon oxide and silicon nitride, an organic material such as polyimide and acrylic, and the like. The first insulating layer 30 and the second insulating layer 31 may be formed of the same material or different materials. For the organic material, a siloxane-based material is preferably used such as a material using an organic group containing at least hydrogen as a substituent (for example, an alkyl group and an aromatic carbon hydride), a material having a skeleton structure of Si—O bond and using a fluoro group as a substituent, or a material having a skeleton structure of Si—O bond and using an organic group containing at least hydrogen and a fluoro group as a substituent are used.

A partition wall layer 32 (also referred to as a bank or an insulating layer) may be formed of an inorganic material or an organic material. However, as an electroluminescent layer of the light emitting element 13 is provided so as to be in contact with the partition wall layer 32, it is preferable that the partition wall layer 32 have a shape of which curvature radius continuously changes so that a pinhole and the like do not occur in the electroluminescent layer. Further, the partition wall layer 32 is preferably formed of a material which reflects light so as to make the boundaries between pixels clear.

Figure 4:
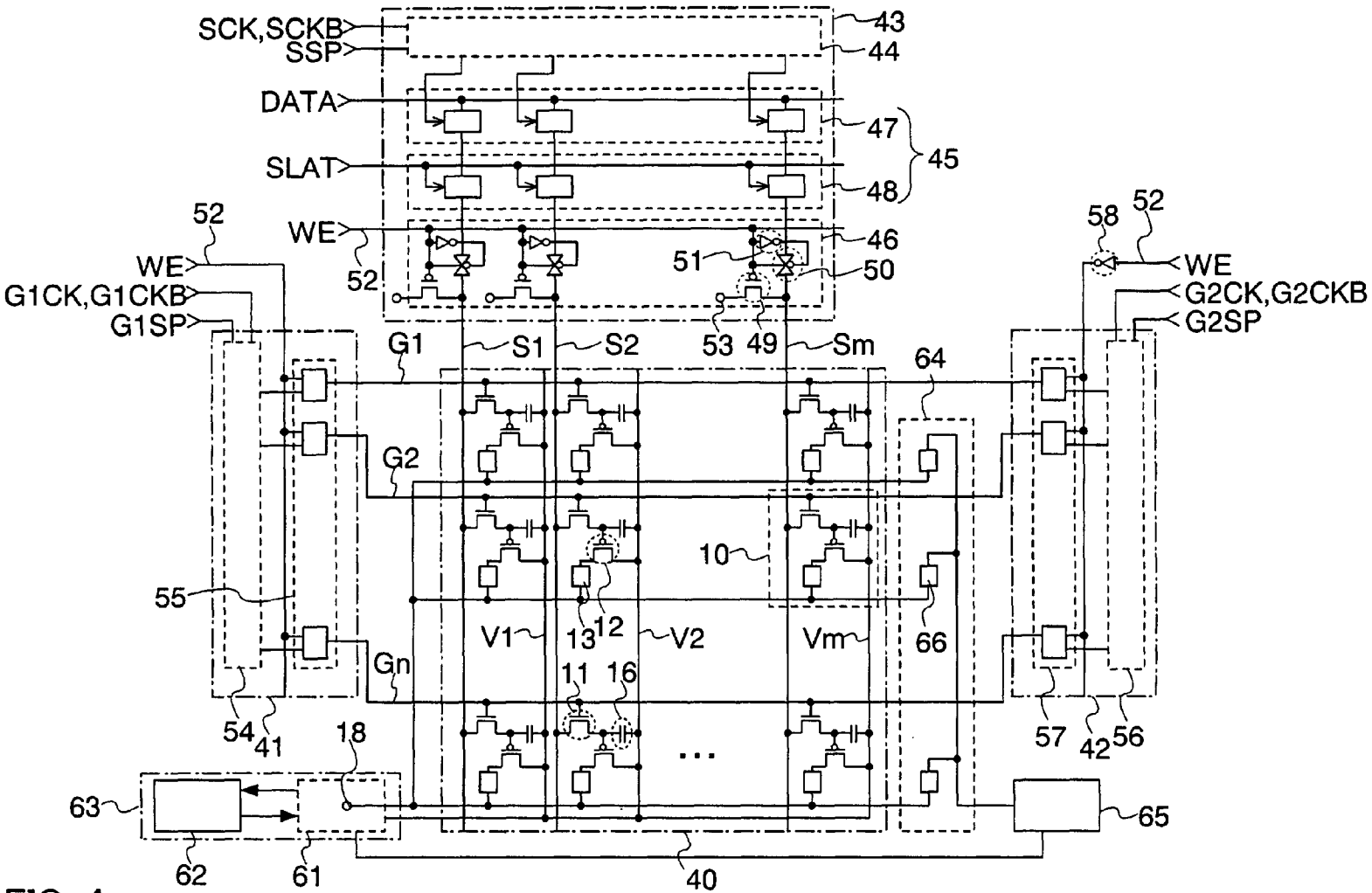
FIG. 4 is a diagram showing a structure of the display device of the invention.

The display device of the invention includes the pixel region 40 in which a plurality of the pixels 10 are arranged in matrix, the first gate driver 41, the second gate driver 42, and the source driver 43 (see FIG. 4). The first gate driver 41 and the second gate driver 42 are provided so as to oppose each other with the pixel region 40 interposed therebetween or one of up, down, left, and right the pixel region 40.

The source driver 43 includes a pulse output circuit 44, a latch 45, and a selection circuit 46. The latch 45 includes a first latch 47 and a second latch 48. The selection circuit 46 includes a transistor 49 and an analog switch 50. The transistor 49 and the analog switch 50 are provided in each column corresponding to the source line Sx. An inverter 51 is provided for generating an inverted WE (Write Erase) signal and is not necessarily provided when an inverted WE signal is supplied externally.

A gate electrode of the transistor 49 is connected to a selection signal line 52, one of a source electrode and a drain electrode thereof is connected to the source line Sx, and the other is connected to a power source 53. An analog switch 50 is provided between the second latch 48 and the source line Sx. In other words, an input node of the analog switch 50 is connected to the second latch 48 while an output node thereof is connected to the source line Sx. One of two control nodes of the analog switch 50 is connected to the selection signal line 52 while the other is connected to the selection signal line 52 through the inverter 51. A potential of the power source 53 is a potential to turn off the driving transistor 12 in the pixel 10. When the driving transistor 12 is an N-channel type, a potential of the power source 53 is L-level whereas when the driving transistor 12 is a P-channel type, the potential of the power source 53 is H-level.

The first gate driver 41 includes a pulse output circuit 54 and a selection circuit 55. The second gate driver 42 includes a pulse output circuit 56 and a selection circuit 57. The selection circuits 55 and 57 are connected to the selection signal line 52. However, the selection circuit 57 included in the second gate driver 42 is connected to the selection signal line 52 through the inverter 58. In other words, WE signals inputted to the selection circuits 55 and 57 through the selection signal line 52 have inverted potentials from each other.

Each of the selection circuits 55 and 57 includes a tristate buffer. An input node of the tristate buffer is connected to the pulse output circuit 54 or the pulse output circuit 56 and a control node thereof is connected to the selection signal line 52. An output node of the tristate buffer is connected to the gate line Gy. The tristate buffer becomes in an operation state when an H-level signal is transmitted from the selection signal line 52 and becomes in a floating state when an L-level is transmitted therefrom.

The pulse output circuit 44 included in the source driver 43, the pulse output circuit 54 included in the first gate driver 41, and the pulse output circuit 56 included in the second gate driver 42 correspond to a shift register or a decoder circuit formed of a plurality of flip-flop circuits. By applying a decoder circuit as the pulse output circuits 44, 54, and 56, the source line Sx and the gate line Gy can be selected at random, thereby a pseudo contour which is generated in the case of time gray scale method can be suppressed.

It is to be noted that the structure of the source driver 43 is not limited to the aforementioned, and a level shifter or a buffer may be provided additionally. The structures of the first gate driver 41 and the second gate driver 42 are not limited to the aforementioned, and a level shifter or a buffer may be provided additionally. A protection circuit may be provided in the source driver 43, the first gate driver 41, and the second gate driver 42.

The display device of the invention includes a power source control circuit 63. The power source control circuit 63 includes a control circuit 62 and a power source circuit 61 which supplies a power source to the light emitting element 13. The power source circuit 61 is connected to the pixel electrode of the light emitting element 13 through the driving transistor 12 and the power source line Vx. Moreover, the power source circuit 61 is connected to the opposite electrode of the light emitting element 13 through a power source line.

In the case where the light emitting element 13 emits light by supplying a current thereto by a forward bias voltage, a potential difference between the power source line Vx and the opposite power source 18 is set so that the potential of the power source line Vx becomes higher than that of the opposite power source 18. Meanwhile, in the case of applying a reverse bias voltage to the light emitting element 13, the potential difference between the power source line Vx and the opposite power source 18 is set so that the potential of the power source line Vx becomes lower than that of the opposite power source 18. The power source is set like this by predetermined signals supplied from the control circuit 62 to the power source circuit 61.

According to the invention, degradation with time of the light emitting element 13 can be suppressed by applying a reverse bias voltage to the light emitting element 13 by using the power source control circuit 63, thus reliability can be improved. Moreover, an initial defect that an anode and a cathode are short-circuited may occur in the light emitting element 13 due to a pinhole or an unevenness of the electroluminescent layer caused by a foreign substance or a fine projection of the anode or the cathode. With such an initial defect, light emission and no light emission of a pixel according to signals cannot be performed, thus almost all current flows to the short-circuited portion between the anode and the cathode and all the elements emit no light or a specific pixel emits light or no light, which results in an unfavorable image display. However, according to the structure of the invention, a reverse bias voltage can be applied to the light emitting element, therefore, the short-circuited portion can be oxidized or carbonized to be insulated (have high resistance) by supplying current locally only to the short-circuited portion to generate heat therein. Consequently, an image can be displayed favorably by eliminating the initial defect. Such an insulation of the initial defect is preferably performed before shipment. The short-circuited portion between the anode and the cathode may occur as time passes other than the initial defect. Such a defect is also called a progressive defect. According to the structure of the invention, a reverse bias voltage can be regularly applied to the light emitting element, thus the progressive defect can be eliminated and an image can be displayed favorably. It is to be noted that a timing to apply a reverse bias voltage to the light emitting element 13 is not particularly limited.

The display device of the invention includes a monitoring circuit 64 including the monitoring light emitting element 66, and a monitoring control circuit 65 including the time-based measurement circuit 101, the memory circuit 102, the correction data forming circuit 103, the constant current source 105, and the like. Detailed structures of the monitoring circuit 64 and the monitoring control circuit 65 are described in Embodiment Mode 1, therefore, detailed descriptions thereon are omitted here. According to the invention having the aforementioned structure, variations in current value of the light emitting element due to changes in the environment temperature and changes with time can be suppressed, thereby reliability can be improved.

Figure 5A:
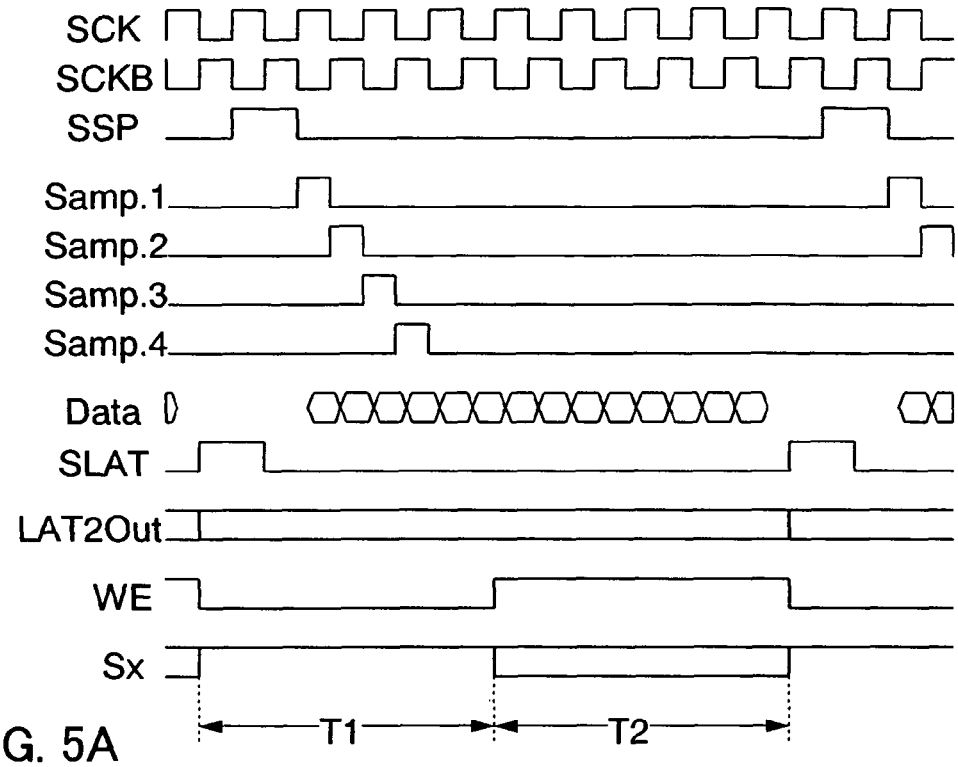
FIGS. 5A and 5B are timing charts showing operations of the display device of the invention.

Next, an operation of the display device of the invention having the aforementioned structure is described with reference to the drawings. First, an operation of a source driver is described with reference to FIG. 5A. A clock signal (hereinafter referred to as SCK), a clock inversion signal (hereinafter referred to as SCKB), and a start pulse (hereinafter referred to as SSP) are inputted to the pulse output circuit 44, and sampling pulses are outputted to the first latch 47 in accordance with the timing of these signals. The first latch 47 to which data is inputted holds video signals from first to last columns in accordance with a timing at which sampling pulses are inputted. Video signals held in the first latch 47 are transferred to the second latch 48 all at once when a latch pulse is inputted.

Here, an operation of the selection circuit 46 in each period is described with a period during which an L-level WE signal is transferred from the selection signal line 52 being called a period T1 whereas a period during which an H-level WE signal is transferred being called a period T2. The periods T1 and T2 correspond to a half of a horizontal scan period. The period T1 is called a first subgate selection period whereas the period T2 is called a second subgate selection period.

In the period T1 (the first subgate selection period), an L-level WE signal is transferred from the selection signal line 52, thereby the transistor 49 is turned on and the analog switch 50 becomes non-conductive. Then, a plurality of signal lines S1 to Sn are electrically connected to the power source 53 through the transistor 49 provided in each column. That is, the plurality of signal lines S1 to Sn each has the same potential as the power source 53.

At this time, the switching transistor 11 included in the pixel 10 is on, thereby the potential of the power source 53 is transferred to the gate electrode of the driving transistor 12 through the switching transistor 11. Then, the driving transistor 12 is turned off and two electrodes of the light emitting element 13 have the same potential. In other words, a current does not flow through the electrodes of the light emitting element 13, thus it emits no light. In this manner, the potential of the power source 53 is transferred to the gate electrode of the driving transistor 12 regardless of the video signal inputted to a video line, thus the switching transistor 11 is turned off and the two electrodes of the light emitting element 13 have the same potential. This operation is called an erase operation.

In the period T2 (second subgate selection period), an H-level WE signal is transferred from the selection signal line 52, thereby the transistor 49 is turned off and the analog switch 50 becomes conductive. Then, video signals held in the second latch 48 are transferred to the plurality of signal lines S1 to Sn for one row at the same time. At this time, the switching transistor 11 included in the pixel 10 is on, thereby the video signal is transferred to the gate electrode of the driving transistor 12 through the switching transistor 11. Then, the driving transistor 12 is turned on or off in accordance with the inputted video signal. Thus, two electrodes of the light emitting element 13 have different potentials or the same potential. More specifically, when the driving transistor 12 is turned on, the two electrodes of the light emitting element 13 have different potentials from each other, thus current flows to the light emitting element 13. In other words, the light emitting element 13 emits light. It is to be noted that the current supplied to the light emitting element 13 is the same as a current flowing between the source and drain of the driving transistor 12.

On the other hand, when the driving transistor 12 is turned off, the two electrodes of the light emitting element 13 have the same potential, thus a current is not supplied to the light emitting element 13. In other words, the light emitting element 13 does not emit light. In this manner, the driving transistor 12 is turned on or off and the two electrodes of the light emitting element 13 have different potentials or the same potential. This operation is called a write operation.

Figure 5B:
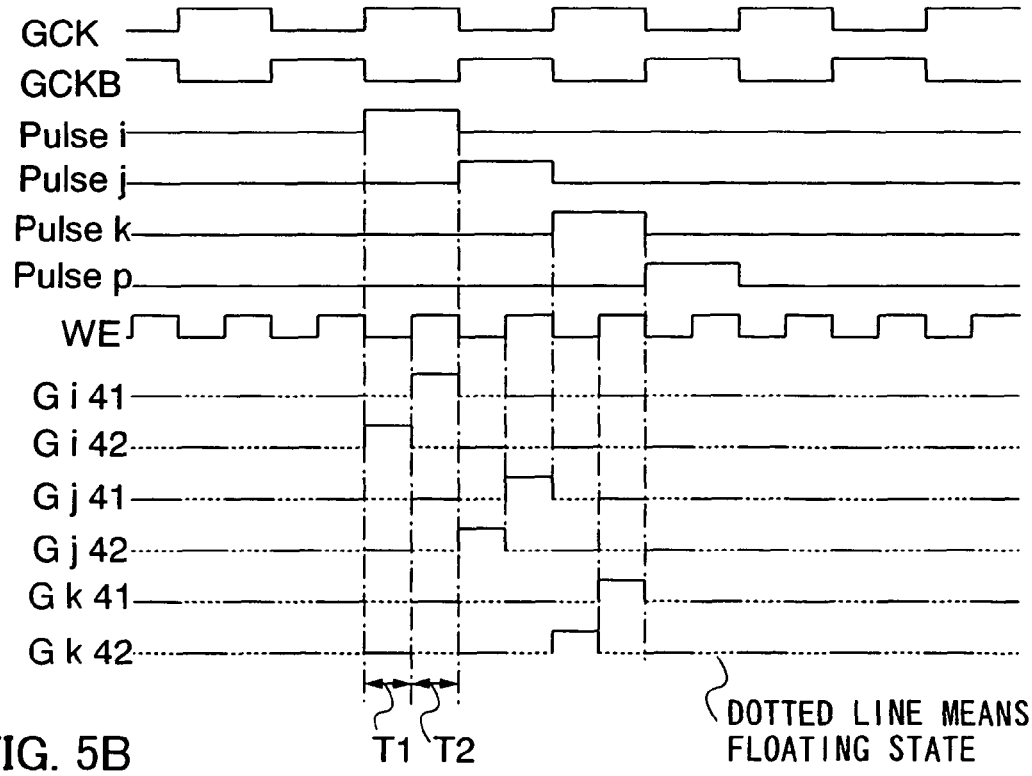

Next, operations of the first gate driver 41 and the second gate driver 42 are described. Signals G1CK, G1CKB, and G1SP are inputted to the pulse output circuit 54, which outputs pulses sequentially to the selection circuit 55 in accordance with a timing of these signals. Signals G2CK, G2CKB, and G2SP are inputted to the pulse output circuit 56, which outputs pulses sequentially to the selection circuit 57 in accordance with a timing of these signals. FIG. 5B shows a potential of a pulse supplied to the selection circuits 55 and 57 of each of the i-th, j-th, k-th, and p-th columns (i, j, k, and p are natural numbers, satisfying 1=i, j, k, and p=n).

Here, similarly to the description on the operation of the source driver 43, operations of the selection circuit 55 included in the first gate driver 41 and the selection circuit 57 included in the second gate driver 42 in each period are described with a period during which an L-level WE signal is transferred from the selection signal line 52 being called a period T1 whereas a period during which an H-level WE signal is transferred being called a period T2. In a timing chart of FIG. 5B, a potential of the gate line Gy (y is a natural number, satisfying 1=y=n) to which a signal is transferred from the first gate driver 41 is denoted as Gy41 whereas a potential of the gate line to which a signal is transferred from the second gate driver 42 is denoted as Gy42. It is needless to say that Gy41 and Gy42 denote the same wiring.

In the period T1 (the first subgate selection period), an L-level WE signal is transferred from the selection signal line 52. Then, an L-level WE signal is inputted to the selection circuit 55 included in the first gate driver 41, thereby the selection circuit 55 becomes a floating state. On the other hand, an inverted WE signal, that is an H-level WE signal is inputted to the selection circuit 57 included in the second gate driver 42, thus the selection circuit 57 becomes an operation state. In other words, the selection circuit 57 transfers an H-level signal (row selection signal) to the i-th gate line G1, thereby the gate line G1 has the same potential as the H-level signal. In other words, the i-th gate line G1 is selected by the second gate driver 42. As a result, the switching transistor 11 included in the pixel 10 is turned on. Then, the potential of the power source 53 included in the source driver 43 is transferred to the gate electrode of the driving transistor 12, thus the driving transistor 12 is turned off and the electrodes of the light emitting element 13 have the same potential. That is, in this period, the erase operation where the light emitting element 13 does not emit light is performed.

In the period T2 (the second subgate selection period), an H-level WE signal is transferred from the selection signal line 52. Then, the H-level WE signal is inputted to the selection circuit 55 included in the first gate driver 41, thereby the selection circuit 55 becomes an operation state. In other words, the selection circuit 55 transfers the H-level signal to the i-th gate line G1, thereby the gate line G1 has the same potential as the H-level signal. That is, the first gate driver 41 selects the i-th gate line G1.

As a result, the switching transistor 11 included in the pixel 10 is turned on. Then, a video signal is transferred from the second latch 48 included in the source driver 43 to the gate electrode of the driving transistor 12. Then, the driving transistor 12 is turned on or off, thus the two electrodes of the light emitting element 13 have different potentials or the same potential. That is, in this period, the write operation where the light emitting element 13 emits light or no light is performed. On the other hand, an L-level signal is inputted to the selection circuit 57 included in the second gate driver 42, and the selection circuit 57 becomes a floating state.

In this manner, the gate line Gy is selected by the second gate driver 42 in the period T1 (the first subgate selection period) whereas it is selected by the first gate driver 41 in the period T2 (the second subgate selection period). In other words, the gate line is complementally controlled by the first gate driver 41 and the second gate driver 42. The erase operation is performed in one of the first and second subgate selection periods while the write operation is performed in the other.

In the period during which the first gate driver 41 selects the i-th gate line G1, the second gate driver 42 does not operate (the selection circuit 57 is in a floating state) or transfers a row selection signal to a gate line of another row than the i-th row. Similarly, the first gate driver 41 is in a floating state or transfers a row selection signal to a gate line of a row other than the i-th row in a period during which the second gate driver 42 transfers a row selection signal to the i-th gate line G1.

According to the invention which performs the aforementioned operation, the light emitting element 13 can be forcibly turned off, which increases a duty ratio. Moreover, as a TFT for releasing a charge in the capacitor 16 is not required, high aperture ratio is realized. With the high aperture ratio, light emission area increases and luminance of the light emitting element decreases, which can decrease the driving voltage and reduce power consumption.

It is to be noted in the invention that the gate selection period is not limited to be divided into two as in the aforementioned embodiment mode, but it may be divided into three or more periods.

Embodiment Mode 3

Figure 6A:
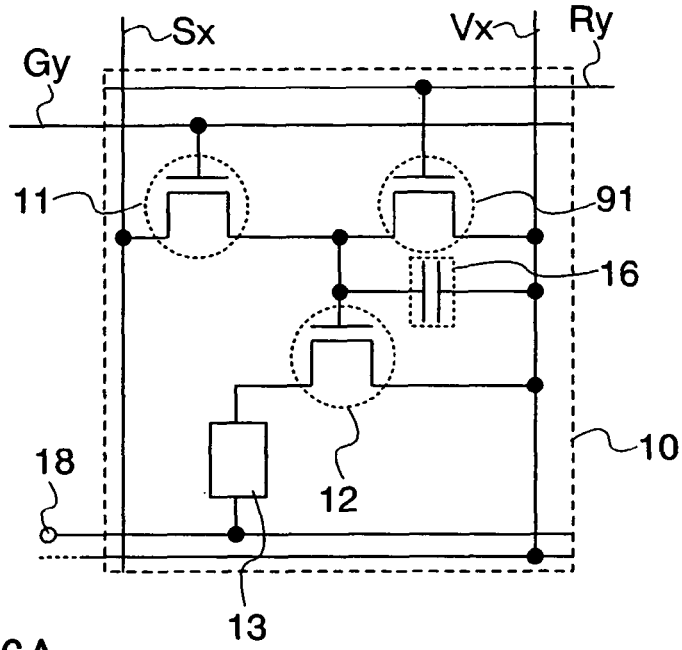
FIGS. 6A and 6B are diagrams showing structures of the display device of the invention.

Hereinafter described is an example of a pixel circuit which can be applied to the display device of the invention. FIG. 6A shows a pixel circuit (pixel circuit provided with three TFTs) in which an erase transistor 91 and an erase gate line Ry are provided additionally to the pixel 10 shown in FIG. 2A. By arranging the erase transistor 91, a current can forcibly be stopped flowing to the light emitting element 13, thus a light emission period can start at the same time as or right after the start of write period without waiting for the writing of signals to all the pixels 10. Therefore, a moving image in particular can be favorably displayed by improving the duty ratio.

Figure 2A:
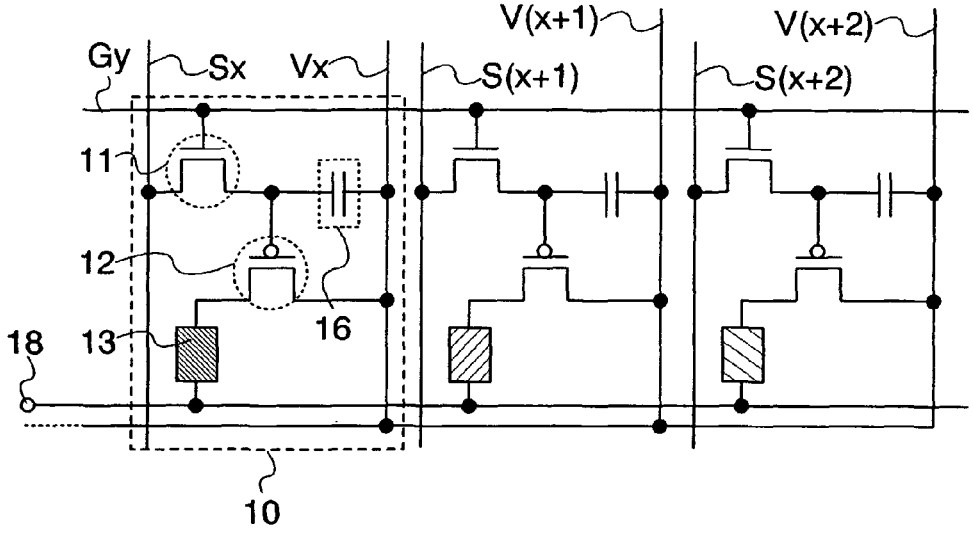
FIGS. 2A and 2B are diagrams showing structures of the display device of the invention.
Figure 6B:
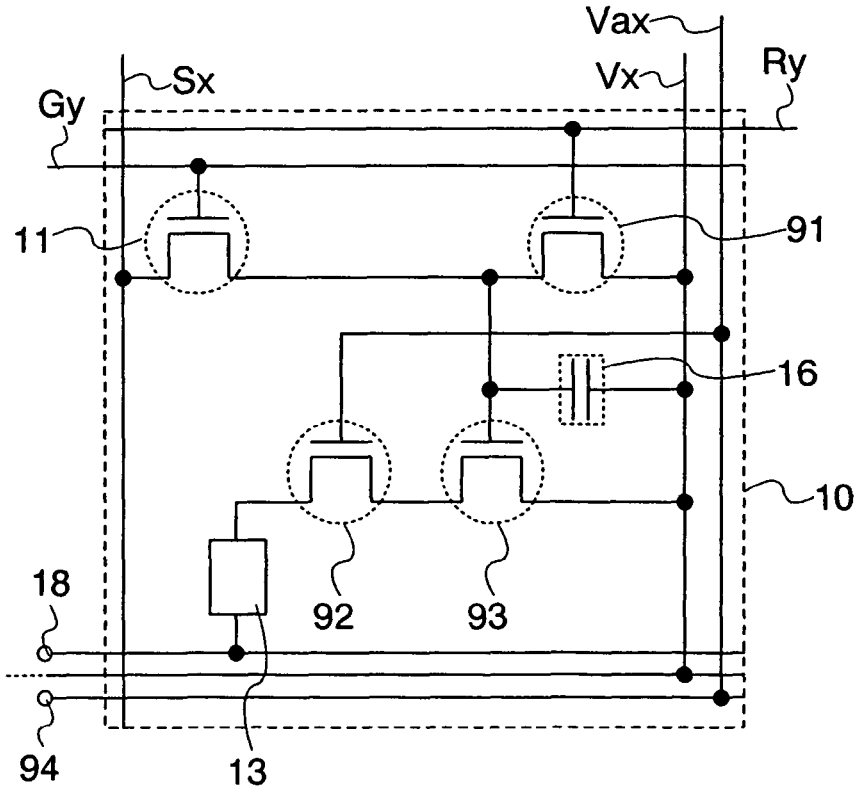

FIG. 6B shows a pixel circuit (pixel circuit provided with four TFTs) in which the driving transistor 12 in the pixel 10 shown in FIG. 2A is removed and transistors 92 and 93, and a power source line Vax (x is a natural number, satisfying 1=x=l) are provided additionally. The power source line Vax is connected to a power source 94. In this structure, a gate electrode of the transistor 92 is connected to the power source line Vax having a constant potential, thereby the potential of the gate electrode of the transistor 92 is fixed and the transistor 92 operates in the saturation region. The transistor 93 operates in the linear region and a gate electrode thereof is inputted with a video signal including data on light emission or no light emission of the pixel 10. As a source-drain voltage of the transistor 93 which operates in the linear region is low, slight variations in a gate-source voltage of the transistor 93 do not affect a current value supplied to the light emitting element 13. Therefore, the current value supplied to the light emitting element 13 is determined by the transistor 92 which operates in the saturation region. According to the invention having the aforementioned structure, an image quality can be enhanced by improving luminance variations of the light emitting element 13 caused by variations in characteristics of the transistor 92.

As a pixel circuit other than the aforementioned, in the pixel 10 of FIG. 2A, a pixel circuit (pixel circuit provided with one TFT) in which the switching transistor 11 is removed may be employed as well. In this case, the same operation as a passive matrix display is performed.

As a pixel circuit other than the aforementioned, a pixel circuit using a current mirror circuit may be employed as well, although not shown.

A material which exhibits light emission of singlet excitation (hereinafter referred to as a singlet exciton material) or a material which exhibits light emission of triplet excitation (hereinafter referred to as a triplet exciton material) are used for the electroluminescent layer. For example, a light emitting element which emits red light of which luminance decreases to half relatively faster is formed of the triplet exciton material while light emitting elements which emit green and blue light are formed of the single exciton material. The triplet exciton material has a favorable light emission efficiency, therefore, the same luminance can be obtained with less power consumption.

The light emitting elements which emit red and green light may be formed of the triplet exciton material while the light emitting element which emits blue light may be formed of the singlet exciton material. By using the triplet exciton material to form the light emitting element which exhibits green light emission which is highly visible to human eyes of, power consumption can further be reduced. As an example of the triplet exciton material, a metal complex is used as a dopant such as a metal complex having as a center metal platinum which is a third transition series element, and a metal complex having as a center metal iridium, and the like. For the electroluminescent layer, any one of a low molecular weight material, a medium molecular weight material, and a high molecular weight material can be used.

A light emitting element may have one of a forward stacking structure in which an anode, an electroluminescent layer, and a cathode are stacked in this order from the bottom, or a reverse stacking structure in which a cathode, an electroluminescent layer, and an anode are stacked in this order from the bottom. For the anode or the cathode of the light emitting element, indium tin oxide (ITO) which transmits light, a material obtained by adding silicon oxide to ITO, indium zinc oxide (IZO), zinc oxide doped with gallium (Ga) (GZO) and the like can be used.

In the case of performing a color display by using a panel including a light emitting element, an electroluminescent layer of different wavelengths is preferably provided in each pixel. Typically, it is preferable to provide electroluminescent layers corresponding to each color of red (R), green (G), and blue (B). In this case, it is preferable to provide the monitoring light emitting element 66 corresponding to each of red, green, and blue, to correct a power source potential per color. In this case, by providing a filter which transmits light of the wavelength on a light emission side of the light emitting element, a color purity can be improved and a mirror surface of the pixel portion (glare) can be prevented. With the filter, a circular polarizer and the like which are conventionally required can be omitted, thus light can be emitted from the electroluminescent layer without loss. Moreover, a change in tone which occurs when the pixel region is seen obliquely can be reduced.

The electroluminescent layer can have a structure which exhibits a mono color or white color light emission. In the case of using a white color light emitting material, a color display can be performed by providing the filter which transmits light of a specific wavelength on a light emission side of the light emitting element.

Embodiment Mode 4

The changes with time of the light emitting element progress drastically in an initial state and less gradually with time. Therefore, the display device using the light emitting element is preferably provided with an initial aging treatment which causes the initial changes of all the light emitting elements with time.

With such an initial aging treatment to cause the drastic changes with time of the light emitting elements in advance, the changes do not progress rapidly after the treatment. Therefore, an image persistence and the like caused by the changes with time can be reduced.

The initial aging treatment is performed by letting the light emitting element emit light for a certain period. It is preferable that a higher voltage than a normal voltage be applied at that time. Accordingly, the initial changes with time can occur in a short time.

Figure 12A:
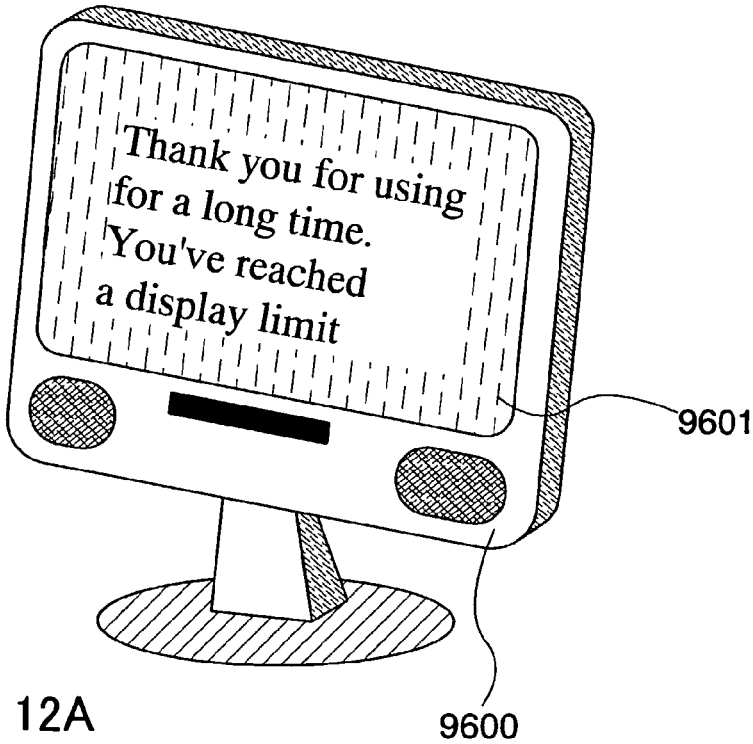
FIGS. 12A and 12B are diagrams showing usage modes of the display device of the invention.
Figure 12B:
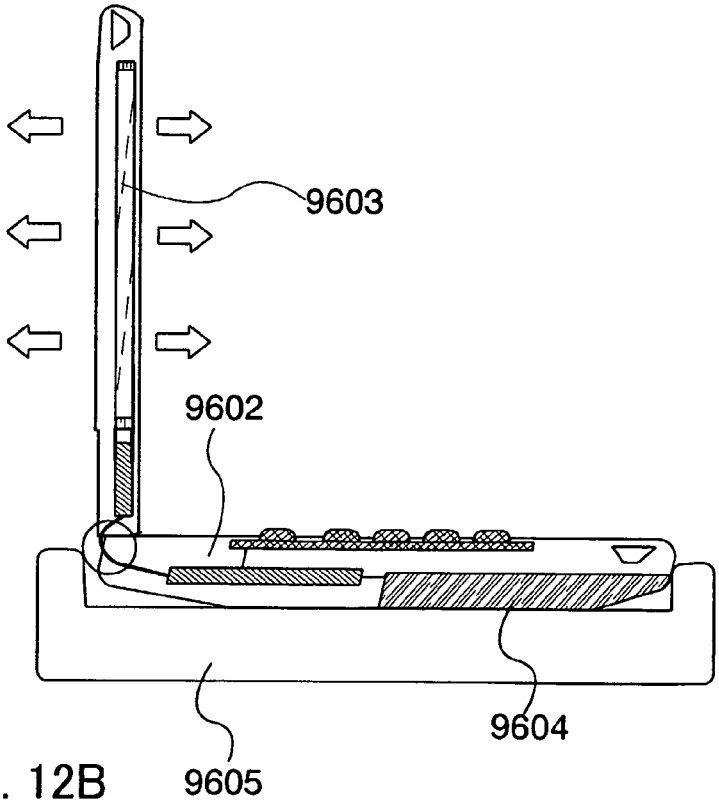

FIG. 12B shows an electronic device 9602 incorporating a secondary battery 9604, which mounts a display device 9603 of which pixel portion is formed of light emitting elements. The display device 9603 is provided with a power source circuit which supplies a power source potential which is corrected based on the output and changes with time of the monitoring light emitting element, and the output of the time-based measurement circuit as described in Embodiment Modes 1 to 3. When charging the electronic device 9602 by a charger 9605, it is preferable to perform a signal process in which all the pixels emit light or blink, a process in which a standard image (such as a stand-by image) of which contrast is inverted is displayed, a process in which a pixel of low light emission frequency by sampling video signals and the pixel emits light or blinks and the like (see FIG. 12B). As described above, the aforementioned process performed for the purpose of reducing the image persistence when the device is not used is referred to as a flash out treatment. By this flash out process, even when image persistence occurs after the flash out process, a difference between the brightest portion and the darkest portion of the image can be set five gray scale level or less, and more preferably one gray scale level or less. Moreover, it is preferable for reducing image persistence by a process other than the aforementioned process to perform a process preventing a stabilization of image. The electronic device 9602 which can operate in this manner includes a portable phone, a computer, an electronic data book, an electronic book and the like. As another mode, the invention can be applied to an electronic device 9600 which displays images and figures as shown in FIG. 12A. The display devices described in Embodiment Modes 1 to 3 are applied to a display portion 9601 of this electronic device 9600 (see FIG. 12A).

There is a limit in the compensation function for the changes with time, therefore, the changes with cannot be corrected when a certain period passes. There is a limit, for example, in the case where a power source IC mounted in the display device cannot afford the increase in power source potential for compensating the increase in resistance value, and the like. In that case, a message "Thank you for using for a long time. You've reached a display limit." is preferably displayed on the display portion 9601 of the display device (see FIG. 12A).

Embodiment Mode 5

Figure 7A:
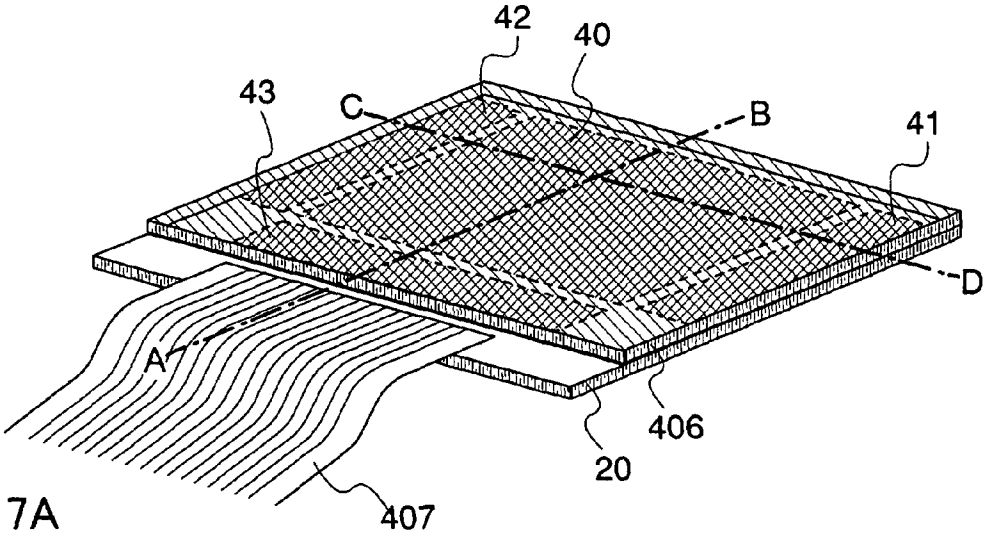
FIGS. 7A and 7B are diagrams showing a panel as one mode of the display device of the invention.

Hereinafter described is a panel mounting the pixel region 40, the first gate driver 41, the second gate driver 42, and the source driver 43, which is one mode of the display device of the invention. The pixel region 40 including a plurality of pixels each having the light emitting element 13, the first gate driver 41, the second gate driver 42, the source driver 43 and a connecting film 407 are provided over the substrate 20 (see FIG. 7A). The connecting film 407 is connected to an external circuit (IC chip).

Figure 7B:
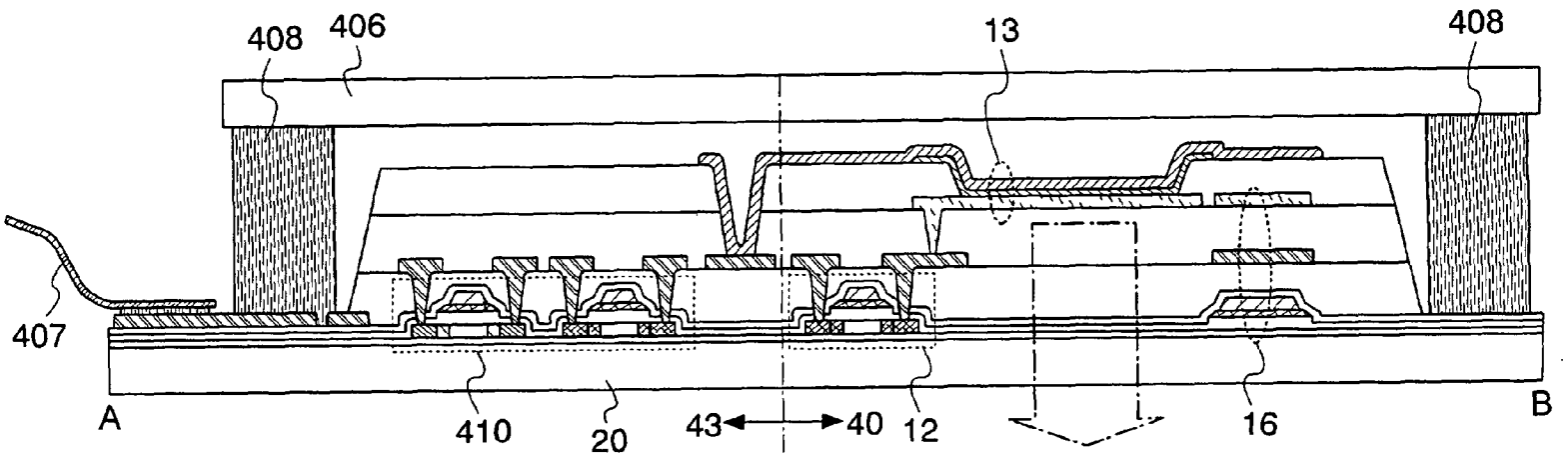

FIG. 7B shows a sectional diagram taken along A-B of a panel, including the pixel region 40 which includes the driving transistor 12, the light emitting element 13, the capacitor 16, and a CMOS circuit 410 provided in the source driver 43.

A sealing material 408 is provided around the pixel region 40, the first gate driver 41, the second gate driver 42, and the source driver 43. The light emitting element 13 is sealed with the sealing material 408 and an opposite substrate 406. This sealing process is performed for protecting the light emitting element 13 from moisture. Here, a covering material (glass, ceramics, plastic, metal and the like) is used for sealing, however, a heat curable resin or an ultraviolet curable resin may be used, or a thin film having high barrier property such as metal oxide and nitride may be used as well. An element formed over the substrate 20 is preferably formed of a crystalline semiconductor (polysilicon) which has favorable mobility and the like as compared to an amorphous semiconductor, thus a monolithic structure over the same surface can be realized. A panel having the aforementioned structure requires less number of external ICs to be connected, therefore, compactness, lightweight, and thin design are achieved.

Figure 11:
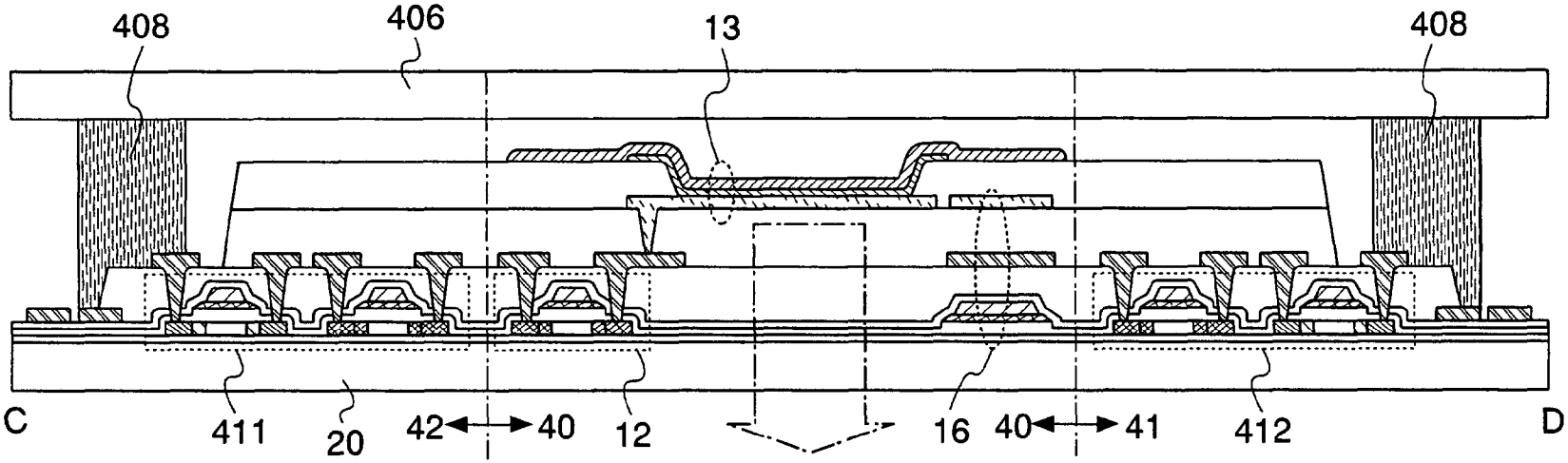
FIG. 11 is a diagram showing a panel as one mode of the display device of the invention.

FIG. 11 shows a sectional diagram taken along C-D of the panel, including the pixel region 40 which includes the driving transistor 12, the light emitting element 13, the capacitor 16, a CMOS circuit 412 provided in the first gate driver 41, and a CMOS circuit 411 provided in the second gate driver 42. The panel in FIG. 11 is provided with the sealing material 408 so as to overlap the first gate driver 41 and the second gate driver 42. With the aforementioned structure, a narrower frame can be formed.

In the structures shown in FIGS. 7B and 11, a pixel electrode of the light emitting element 13 transmits light, and the opposite electrode of the light emitting element 13 reflects light. Therefore, the light emitting element 13 performs the bottom light emission.

Figure 8A:
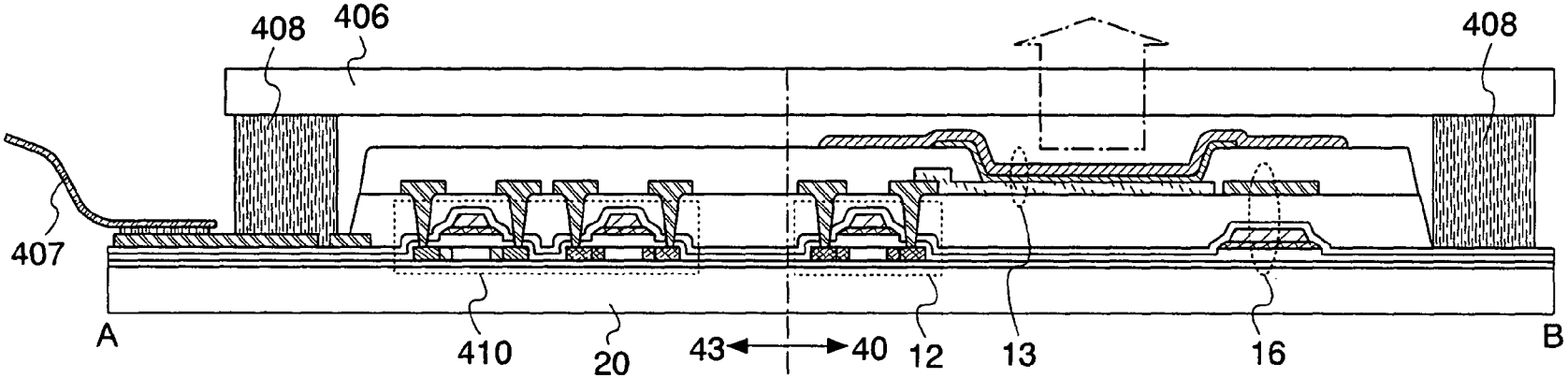
FIGS. 8A and 8B are diagrams showing a panel as one mode of the display device of the invention.

As another structure, there is a case where the pixel electrode of the light emitting element 13 reflects light while the opposite electrode thereof transmits light. In this case, the light emitting element 13 performs the top light emission (see FIG. 8A).

Figure 8B:
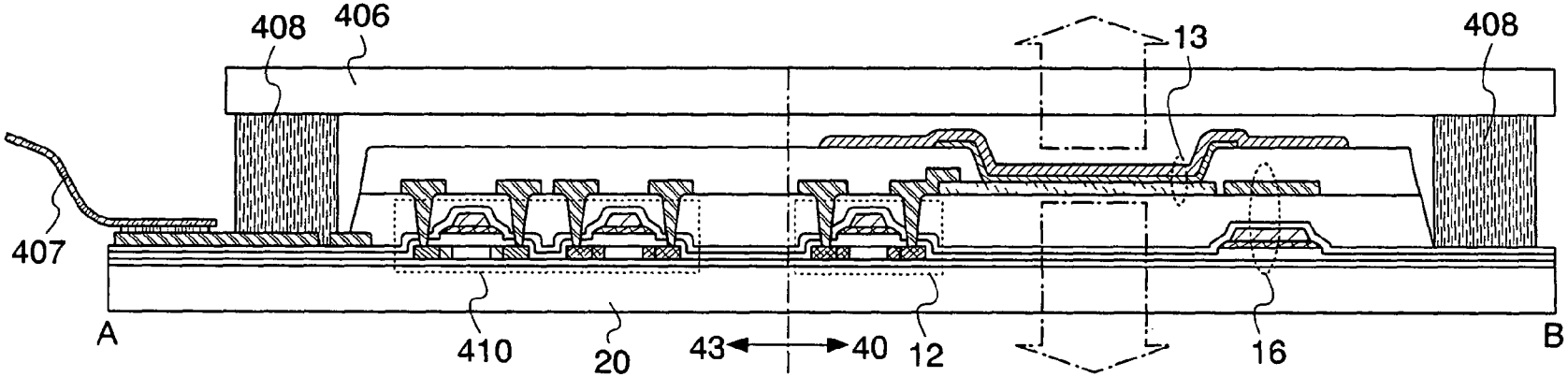

As another structure, there is a case where the pixel electrode and the opposite electrode of the light emitting element 13 transmit light. In this case, the light emitting element 13 performs the dual light emission (see FIG. 8B).

In the case of the bottom light emission and the dual light emission, it is preferable that a conductive layer (a source wiring or a drain wiring) connected to an impurity region included in the driving transistor 12 be formed of a material obtained by mixing aluminum (Al) and a material having low reflectivity such as molybdenum (Mo). In specific, a stacked-layer structure of Mo, Al—Si, and Mo, a stacked-layer structure of MoN, Al—Si, and MoN and the like are preferably used. Accordingly, it can be prevented that light emitted from the light emitting element reflects on the source wiring or the drain wiring, thereby the light can be emitted outside. The display device of the invention may employ any one of the bottom, top, and dual light emission.

It is to be noted that the pixel region 40 may be formed of TFTs formed over an insulating surface, each having a channel portion formed of an amorphous semiconductor (amorphous silicon), and the first gate driver 41, the second gate driver 42, and the source driver 43 may be formed of IC chips. The IC chip may be adhered to the substrate 20 by a COG method or adhered to the connecting film 407 which is connected to the substrate 20. The amorphous semiconductor can be easily formed over a large substrate by a CVD method, and an inexpensive panel can be provided as a crystallization step is not required. By forming a conductive layer by a droplet discharge method represented by an ink-jetting method, a more inexpensive panel can be provided.

Embodiment Mode 6

Examples of electronic devices provided with a pixel region including a light emitting element are, a television set (also referred to simply as a television or a television receiver), a digital camera, a digital video camera, a portable phone device (also referred to simply as a portable phone or a mobile phone), a portable information terminal such as a PDA, a portable game machine, a monitor of a computer, a computer, an audio reproducing device such as a car audio set, an image reproducing device provided with a recording medium such as a home game machine, and the like. Specific examples of these are described with reference to FIGS. 9A to 9E.

Figure 9A:
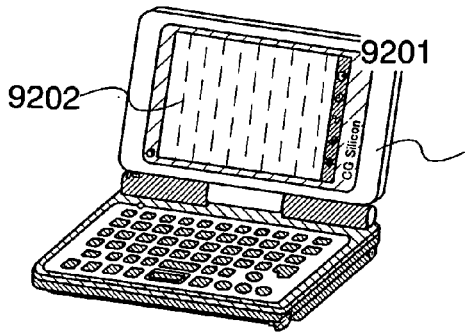
FIGS. 9A to 9F are views of electronic devices each using the display device of the invention.

A portable information terminal includes a main body 9201, a display portion 9202, and the like (see FIG. 9A). The display devices described in Embodiment Modes 1 to 5 can be applied to the display portion 9202. According to the invention which employs a constant voltage drive, a drive voltage of the light emitting element can be lower as compared to the case of using a constant current drive, thus power consumption can be reduced. By correcting the power source potential applied to the light emitting element by using the monitoring light emitting element, a display device in which an effect of variations in current value of the light emitting element caused by changes in the environment temperature and changes with time is suppressed can be provided.

Figure 9B:
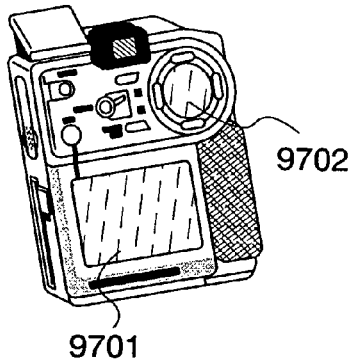

A digital video camera includes a display portion 9701, a display portion 9702 and the like (see FIG. 9B). The display devices described in Embodiment Modes 1 to 5 can be applied to the display portion 9701. According to the invention which employs a constant voltage drive, a drive voltage of the light emitting element can be lower as compared to the case of using a constant current drive, thus power consumption can be reduced. By correcting the power source potential applied to the light emitting element by using the monitoring light emitting element, a display device in which an effect of variations in current value of the light emitting element caused by changes in the environment temperature and changes with time is suppressed can be provided.

Figure 9C:
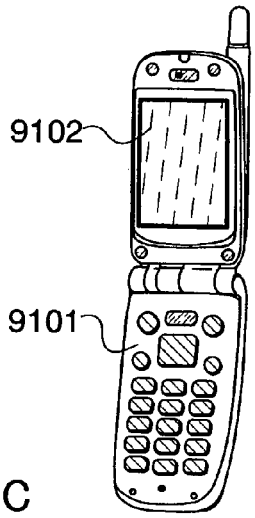

A portable terminal includes a main body 9101, a display portion 9102 and the like (see FIG. 9C). The display devices described in Embodiment Modes 1 to 5 can be applied to the display portion 9102. According to the invention which employs a constant voltage drive, a drive voltage of the light emitting element can be low as compared to the case of using a constant current drive, thus power consumption can be reduced. By correcting the power source potential applied to the light emitting element by using the monitoring light emitting element, a display device in which an effect of variations in current value of the light emitting element caused by changes in the environment temperature and changes with time is suppressed can be provided.

Figure 9D:
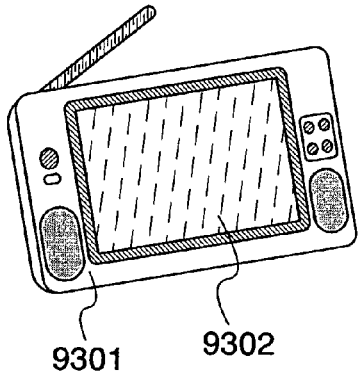

A portable television set includes a main body 9301, a display portion 9302 and the like (see FIG. 9D). The display devices described in Embodiment Modes 1 to 5 can be applied to the display portion 9302. According to the invention which employs a constant voltage drive, a drive voltage of the light emitting element can be low as compared to the case of using a constant current drive, thus power consumption can be reduced. By correcting the power source potential applied to the light emitting element by using the monitoring light emitting element, a display device in which an effect of variations in current value of the light emitting element caused by changes in the environment temperature and changes with time is suppressed can be provided. Such a television set can be widely applied to a small television set mounted in a portable terminal such as a portable phone, a medium television set which is portable, and a large televisions set (for example, 40 inches or larger).

Figure 9E:
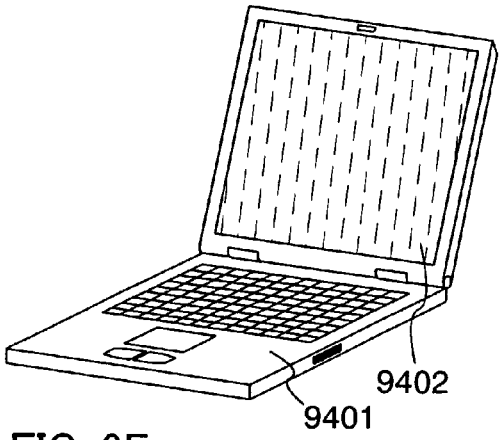

A portable computer includes a main body 9401, a display portion 9402 and the like (see FIG. 9E). The display devices described in Embodiment Modes 1 to 5 can be applied to the display portion 9402. According to the invention which employs a constant voltage drive, a drive voltage of the light emitting element can be lower as compared to the case of using a constant current drive, thus power consumption can be reduced. By correcting the power source potential applied to the light emitting element by using the monitoring light emitting element, a display device in which an effect of variations in current value of the light emitting element caused by changes in the environment temperature and changes with time is suppressed can be provided.

Figure 9F:
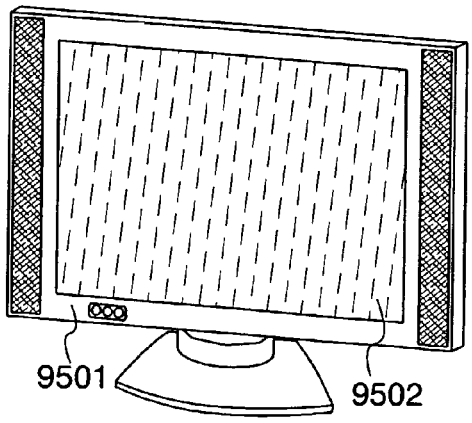

A television set includes a main body 9501, a display portion 9502 and the like (see FIG. 9F). The display devices described in Embodiment Modes 1 to 5 can be applied to the display portion 9502. According to the invention which employs a constant voltage drive, a drive voltage of the light emitting element can be lower as compared to the case of using a constant current drive, thus power consumption can be reduced. By correcting the power source potential applied to the light emitting element by using the monitoring light emitting element, a display device in which an effect of variations in current value of the light emitting element caused by changes in the environment temperature and changes with time is suppressed can be provided.

By using a secondary battery in the aforementioned electronic devices, the device can be used longer as power consumption is reduced. Thus a step of charging the secondary battery can be omitted.

This application is based on Japanese Patent Application serial no. 2004-152600 filed in Japan Patent Office on May 21, 2004, the contents of which are hereby incorporated by reference.

EXPLANATION OF REFERENCE

10 . . . pixel, 11 . . . switching transistor, 12 . . . driving transistor, 13 . . . light emitting element, 16 . . . capacitor, 18 . . . opposite power source, 19 . . . conductive layer, 20 . . . substrate, 22 . . . conductive layer, 22*a* . . . conductive layer, 22*b* . . . conductive layer, 24 . . . conductive layer, 25 . . . conductive layer, 26 . . . conductive layer, 27 . . . conductive layer, 28 . . . insulating layer, 29 . . . insulating layer, 30 . . . first insulating layer, 31 . . . second insulating layer, 32 . . . partition wall layer, 33 . . . electroluminescent layer, 34 . . . conductive layer, 35 . . . conductive layer, 36 . . . conductive layer, 40 . . . pixel region, 41 . . . first gate driver, 42 . . . second gate driver, 43 . . . source driver, 44 . . . output circuit, 45 . . . latch, 46 . . . selection circuit, 47 . . . latch, 48 . . . latch, 49 . . . transistor, 50 . . . analog switch, 51 . . . inverter, 52 . . . selection signal line, 53 . . . power source, 54 . . . output circuit, 55 . . . selection circuit, 56 . . . output circuit, 57 . . . selection circuit, 58 . . . inverter, 61 . . . power source circuit, 62 . . . control circuit, 63 . . . power source control circuit, 64 . . . monitoring circuit, 65 . . . monitoring control circuit, 66 . . . monitoring light emitting element, 91 . . . transistor, 92 . . . transistor, 93 . . . transistor, 94 . . . power source, 101 . . . time-based measurement circuit, 102 . . . memory circuit, 103 . . . correction data forming circuit, 104 . . . power source circuit, 105 . . . constant current source, 406 . . . opposite substrate, 407 . . . connecting film, 408 . . . sealing material, 410 . . . CMOS circuit, 411 . . . CMOS circuit, 412 . . . CMOS circuit, 9101 . . . main body, 9102 . . . display portion, 9201 . . . main body, 9202 . . . display portion, 9301 . . . main body, 9302 . . . display portion, 9401 . . . main body, 9402 . . . display portion, 9501 . . . main body, 9502 . . . display portion, 9600 . . . electronic device, 9601 . . . display portion, 9602 . . . electronic device, 9701 . . . display portion, 9702 . . . display portion

The invention claimed is:

1. A display device comprising:

a substrate;

a panel comprising:

a source driver circuit comprising:

a latch circuit;

a selection signal line;

an inverter;

an analog switch configured to control electrical connection between the latch circuit and a source signal line; and a transistor configured to control electrical connection between a power source and the source signal line;

a first gate driver circuit comprising:

a first selection circuit comprising:

a first tristate buffer;

a second gate driver circuit comprising:

a second selection circuit comprising:

a second tristate buffer; and a pixel region comprising a pixel comprising:

a light emitting element over the substrate; and a first transistor over the substrate, electrically connected to the first selection circuit via a gate signal line, and to the second selection circuit via the gate signal line;

a monitoring circuit comprising a monitoring light emitting element;

a constant current source electrically connected to the monitoring light emitting element;

a power source circuit electrically connected to the light emitting element;

a correction data forming circuit electrically connected to the monitoring light emitting element and the power source circuit;

a memory circuit for storing voltage-current characteristics of the light emitting element in each of a plurality of lapsed times; and a time-based measurement circuit for measuring time during which the power source circuit supplies a power source to the panel, wherein the correction data forming circuit forms a correction signal based on an output of the memory circuit and an output of the time-based measurement circuit, wherein a first control node of the analog switch is directly electrically connected to the selection signal line, a gate of the transistor, and an input node of the inverter, and wherein a second control node of the analog switch is directly electrically connected to an output node of the inverter.

2. The display device according to claim 1, wherein one of a first electrode and a second electrode of the light emitting element transmits light and the other thereof reflects light.

3. The display device according to claim 1, wherein at least one of a first electrode and a second electrode of the light emitting element transmits light.

4. The display device according to claim 1, wherein the monitoring light emitting element is formed over the substrate.

5. The electronic device using the display device according to claim 1, wherein the electronic device is one selected from the group consisting of a television set, a digital camera, a digital video camera, a portable phone device, a portable information terminal, a portable game machine, a monitor of a computer, a computer, an audio reproducing device, and an image reproducing device provided with a recording medium.

6. The display device according to claim 1, wherein the monitoring circuit comprises a plurality of monitoring light emitting elements.

7. A display device comprising:

a substrate;

a panel comprising:

a source driver circuit comprising:

a latch circuit;

a selection signal line;

an inverter;

an analog switch configured to control electrical connection between the latch circuit and a source signal line; and a transistor configured to control electrical connection between a power source and the source signal line;

a first gate driver circuit comprising:

a first selection circuit comprising:

a first tristate buffer;

a second gate driver circuit comprising:

a second selection circuit comprising:

a second tristate buffer; and a pixel region comprising a pixel comprising:

a light emitting element over the substrate; and a first transistor over the substrate, electrically connected to the first selection circuit via a gate signal line, and to the second selection circuit via the gate signal line;

a monitoring circuit comprising a monitoring light emitting element;

a constant current source electrically connected to the monitoring light emitting element;

a power source circuit electrically connected to the light emitting element;

a correction data forming circuit electrically connected to the monitoring light emitting element and the power source circuit;

a memory circuit for storing voltage-current characteristics of the light emitting element in each of a plurality of lapsed times; and a time-based measurement circuit for measuring a light emission time of the light emitting element, wherein the correction data forming circuit forms a correction signal based on an output of the memory circuit and an output of the time-based measurement circuit, wherein a first control node of the analog switch is directly electrically connected to the selection signal line, a gate of the transistor, and an input node of the inverter, and wherein a second control node of the analog switch is directly electrically connected to an output node of the inverter.

8. The display device according to claim 7, wherein one of a first electrode and a second electrode of the light emitting element transmits light and the other thereof reflects light.

9. The display device according to claim 7, wherein at least one of a first electrode and a second electrode of the light emitting element transmits light.

10. The display device according to claim 7, wherein the monitoring light emitting element is formed over the substrate.

11. The electronic device using the display device according to claim 7, wherein the electronic device is one selected from the group consisting of a television set, a digital camera, a digital video camera, a portable phone device, a portable information terminal, a portable game machine, a monitor of a computer, a computer, an audio reproducing device, and an image reproducing device provided with a recording medium.

12. The display device according to claim 7, wherein the monitoring circuit comprises a plurality of monitoring light emitting elements.

13. The display device according to claim 7, wherein the pixel region comprising a plurality of pixels, and wherein the time-based measurement circuit is configured to calculate light emission time of some of the plurality of pixels and to obtain an average value.

14. A display device comprising:

a substrate;

a panel comprising:

a source driver circuit comprising:

a latch circuit;

a selection signal line;

an inverter;

an analog switch configured to control electrical connection between the latch circuit and a source signal line; and a transistor configured to control electrical connection between a power source and the source signal line;

a first gate driver circuit comprising:

a first selection circuit comprising:

a first tristate buffer;

a second gate driver circuit comprising:

a second selection circuit comprising:

a second tristate buffer; and a pixel region comprising a pixel comprising:

a light emitting element over the substrate;

a first transistor over the substrate, electrically connected to the source driver circuit via the source signal line, to the first selection circuit via a gate signal line, and to the second selection circuit via the gate signal line; and a second transistor electrically connected to the first transistor;

a monitoring circuit comprising a monitoring light emitting element;

a constant current source electrically connected to the monitoring light emitting element;

a power source circuit electrically connected to the light emitting element via the second transistor;

a correction data forming circuit electrically connected to the monitoring light emitting element and the power source circuit;

a memory circuit for storing voltage-current characteristics of the light emitting element in each of a plurality of lapsed times; and a time-based measurement circuit for measuring time during which the power source circuit supplies a power source to the panel, wherein the correction data forming circuit forms a correction signal based on an output of the memory circuit and an output of the time-based measurement circuit, wherein a first control node of the analog switch is directly electrically connected to the selection signal line, a gate of the transistor, and an input node of the inverter, and wherein a second control node of the analog switch is directly electrically connected to an output node of the inverter.

15. The display device according to claim 14, wherein one of a first electrode and a second electrode of the light emitting element transmits light and the other thereof reflects light.

16. The display device according to claim 14, wherein at least one of a first electrode and a second electrode of the light emitting element transmits light.

17. The display device according to claim 14, wherein the monitoring light emitting element is formed over the substrate.

18. The electronic device using the display device according to claim 14, wherein the electronic device is one selected from the group consisting of a television set, a digital camera, a digital video camera, a portable phone device, a portable information terminal, a portable game machine, a monitor of a computer, a computer, an audio reproducing device, and an image reproducing device provided with a recording medium.

19. The display device according to claim 14, wherein the monitoring circuit comprises a plurality of monitoring light emitting elements.

20. A display device comprising:

a substrate;

a panel comprising:

a source driver circuit comprising:

a latch circuit;

a selection signal line;

an inverter;

an analog switch configured to control electrical connection between the latch circuit and a source signal line; and a transistor configured to control electrical connection between a power source and the source signal line;

a first gate driver circuit comprising:

a first selection circuit comprising:

a first tristate buffer;

a second gate driver circuit comprising:

a second selection circuit comprising:

a second tristate buffer; and a pixel region comprising a pixel comprising:

a light emitting element over the substrate;

a first transistor over the substrate, electrically connected to the source driver circuit via the source signal line, to the first selection circuit via a gate signal line, and to the second selection circuit via the gate signal line; and a second transistor electrically connected to the first transistor;

a monitoring circuit comprising a monitoring light emitting element;

a constant current source electrically connected to the monitoring light emitting element;

a power source circuit electrically connected to the light emitting element via the second transistor;

a correction data forming circuit electrically connected to the monitoring light emitting element and the power source circuit;

a memory circuit for storing voltage-current characteristics of the light emitting element in each of a plurality of lapsed times; and a time-based measurement circuit for measuring a light emission time of the light emitting element, wherein the correction data forming circuit forms a correction signal based on an output of the memory circuit and an output of the time-based measurement circuit, wherein a first control node of the analog switch is directly electrically connected to the selection signal line, a gate of the transistor, and an input node of the inverter, and wherein a second control node of the analog switch is directly electrically connected to an output node of the inverter.

21. The display device according to claim 20, wherein one of a first electrode and a second electrode of the light emitting element transmits light and the other thereof reflects light.

22. The display device according to claim 20, wherein at least one of a first electrode and a second electrode of the light emitting element transmits light.

23. The display device according to claim 20, wherein the monitoring light emitting element is formed over the substrate.

24. The electronic device using the display device according to claim 20, wherein the electronic device is one selected from the group consisting of a television set, a digital camera, a digital video camera, a portable phone device, a portable information terminal, a portable game machine, a monitor of a computer, a computer, an audio reproducing device, and an image reproducing device provided with a recording medium.

25. The display device according to claim 20, wherein the monitoring circuit comprises a plurality of monitoring light emitting elements.

26. The display device according to claim 20, wherein the pixel region comprising a plurality of pixels, and wherein the time-based measurement circuit is configured to calculate light emission time of some of the plurality of the pixels and to obtain an average value.

* * * * *

UNITED STATES PATENT AND TRADEMARK OFFICE

CERTIFICATE OF CORRECTION

PATENT NO. : 8,144,146 B2
APPLICATION NO. : 11/579818
DATED : March 27, 2012
INVENTOR(S) : Shunpei Yamazaki et al.

Figure 10A:
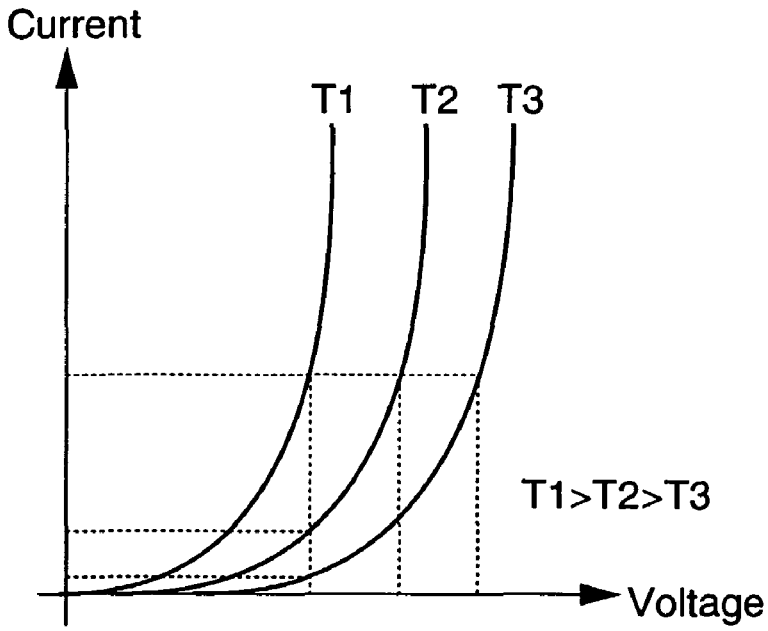
FIGS. 10A and 10B are graphs showing temperature characteristics and characteristics with time of the light emitting element.
Figure 10B:
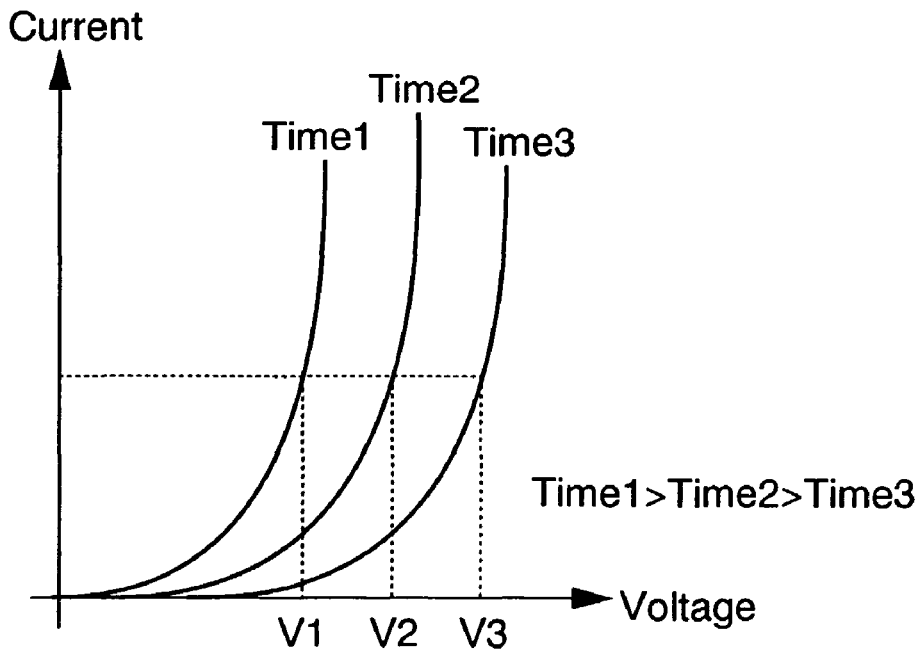

It is certified that error appears in the above-identified patent and that said Letters Patent is hereby corrected as shown below:

In the Specification,

Col. 1, line 39, "temperature (see FIG. 1A)." should read "temperature (see FIG. 10A)."

Col. 12, line 43, "to the i-th gate line G1," should read "to the i-th gate line Gi,"

Col. 12, line 44, "thereby the gate line G1 has" should read "thereby the gate line Gi has"

Col. 12, line 45, "In other words, the i-th gate line G1 is selected" should read
"In other words, the i-th gate line Gi is selected"

Col. 12, line 60, "the i-th gate line G1, thereby the gate line G1 has the same" should read
"the i-th gate line Gi, thereby the gate line Gi has the same"

Col. 12, line 62, "selects the i-th gate line G1." should read "selects the i-th gate line Gi."

Col. 13, line 17, "i-th gate line G1, the second gate driver 42" should read
"i-th gate line Gi, the second gate driver 42"

Col. 13, lines 23-24, "a row selection signal to the i-th gate line G1." should read
"a row selection signal to the i-th gate line Gi."

Signed and Sealed this
Twenty-sixth Day of June, 2012

David J. Kappos

David J. Kappos
*Director of the United States Patent and Trademark Office*